US012378743B2

(12) United States Patent
Lu et al.

(10) Patent No.: US 12,378,743 B2
(45) Date of Patent: Aug. 5, 2025

(54) MULTI-PIECE PRE-ASSEMBLED RAFT FOUNDATION AND CONSTRUCTION METHOD THEREOF

(71) Applicants: Fu-Yuan Lu, Kaohsiung (TW); Ju-Chuan Ko, Kaohsiung (TW); Ying-Ying Lu, Kaohsiung (TW); Chien-Hui Lu, Kaohsiung (TW); Cheng-Yu Lee, Kaohsiung (TW); Mei-Hua Chien, Kaohsiung (TW); Guang-Le Su, Kaohsiung (TW); Sen Taner, Kaohsiung (TW)

(72) Inventors: Fu-Yuan Lu, Kaohsiung (TW); Ju-Chuan Ko, Kaohsiung (TW); Ying-Ying Lu, Kaohsiung (TW); Chien-Hui Lu, Kaohsiung (TW); Cheng-Yu Lee, Kaohsiung (TW); Mei-Hua Chien, Kaohsiung (TW); Guang-Le Su, Kaohsiung (TW); Sen Taner, Kaohsiung (TW)

(73) Assignees: Jyu Sin Steel Co., Ltd, Kaohsiung (TW); Cheng Chi Steel Co., Ltd, Kaohsiung (TW)

( * ) Notice: Subject to any disclaimer, the term of this patent is extended or adjusted under 35 U.S.C. 154(b) by 137 days.

(21) Appl. No.: 18/170,622

(22) Filed: Feb. 17, 2023

(65) Prior Publication Data

US 2023/0265635 A1 Aug. 24, 2023

(51) Int. Cl.
*E02D 27/08* (2006.01)
*E04C 5/06* (2006.01)

(52) U.S. Cl.
CPC ..... *E02D 27/08* (2013.01); *E04C 5/0631* (2013.01); *E02D 2300/0034* (2013.01)

(58) Field of Classification Search
CPC ..... E02D 27/08; E04C 5/0604; E04C 5/0609; E04C 5/0613; E04C 5/0627; E04C 5/0631; E04C 5/0636; E04C 5/064
USPC ..... 52/294, 296, 299
See application file for complete search history.

(56) References Cited

U.S. PATENT DOCUMENTS

| | | | | |
|---|---|---|---|---|
| 8,544,227 | B2 * | 10/2013 | Gullette | E04G 15/061 52/297 |
| 2012/0047835 | A1 * | 3/2012 | Zhong | E04G 17/0658 52/745.1 |
| 2016/0108618 | A1 * | 4/2016 | Buzimkic | E04C 2/06 52/649.1 |
| 2016/0108619 | A1 * | 4/2016 | Buzimkic | E04C 5/0609 52/719 |
| 2017/0022699 | A1 * | 1/2017 | Lim | E04C 2/296 |

FOREIGN PATENT DOCUMENTS

| | | | | |
|---|---|---|---|---|
| CN | 205576955 U | * | 9/2016 | |
| CN | 111005504 A | * | 4/2020 | E04C 5/18 |
| CN | 111042177 A | * | 4/2020 | |
| KR | 20210016812 A | * | 2/2021 | |

* cited by examiner

*Primary Examiner* — Frederick L Lagman

(57) ABSTRACT

A multi-piece pre-assembled raft foundation is provided and includes pre-assemble bottom layer rebars of foundation slab, foundation steel columns, upper layer rebars of the foundation slab, and foundation rebars. The pre-assembled raft foundation is transported to a construction site for final assembly. A construction method of the multi-piece pre-assembled raft foundation is also provided.

5 Claims, 30 Drawing Sheets

MULTI-PIECE PRE-ASSEMBLED RAFT FOUNDATION AND CONSTRUCTION METHOD THEREOF

FIELD OF THE INVENTION

The invention relates to raft foundations and more particularly to a multi-piece pre-assembled raft foundation and construction method thereof.

BACKGROUND OF THE INVENTION

In general, during the construction, all needed rebars will be delivered to and stored in the construction site for construction workers to tie the rebars and build a formwork before grouting. According to the current construction practice, from the start of tying rebars to the last task of demolding rely on labor-based construction.

Therefore, to construct a building is considered a labor-intensive operation. When a construction project highly depends on workers to carry out the task will likely result in a slow progress in construction and the vast volume of unused rebars piled up in the construction site may heighten the risk of property theft. Furthermore, when there is a need of secondary grouting for a structure, if it is not carefully done, cold joints may occur after the grouting that damage the concrete structure.

Thus, the need for improvement still exists.

SUMMARY OF THE INVENTION

It is therefore the first object of the invention to provide a pre-assembled raft foundation that reduce construction labor and time.

The secondary object of the invention is to provide a pivot element for adjusting the installation location so that the rebar installation is more convenient and simple, and the cost of material consumption is less.

To achieve the aforementioned objects, the pre-assembled raft foundation of the invention comprises the bottom layer rebars of the foundation slab, foundation steel columns, upper layer rebars of the foundation slab, and foundation rebars.

The bottom layer rebar of the foundation slab comprises bottom layer sections and the first vertical sections that are connected with the bottom layer sections; the bottom layer section and the first vertical section are composed of a plurality of U-shaped rebars and steel bars that are installed on the U-shaped rebars.

The foundation steel columns are installed on the bottom layer section, wherein the foundation steel column comprises columns and vertical pivot sections that are installed at the top of the column.

The upper layer rebars of the foundation slab are installed on the bottom layer rebars of the foundation slab, wherein the upper layer rebar of the foundation slab comprises the top layer sections and second vertical sections that are connected with the top layer sections; the top layer section and the second vertical section are composed of a plurality of U-shaped rebars and steel bars that are installed on the U-shaped rebars.

The foundation rebar, installed on the side of the foundation steel columns, comprises a plurality of beams and columns, horizontal pivot sections that are installed at both ends of the beams and columns, and steel mesh structures, wherein the plurality of beams and columns are tied together by circular rebars and are secured by steel mesh structures installed above and below the beams and columns.

Last, the bottom layer rebars of the foundation slab, foundation steel columns, upper layer rebars of the foundation slab, and foundation rebars are assembled into a pre-assembled raft foundation.

Furthermore, the pre-assembled raft foundation construction method of the invention comprises the following steps.

- a pre-assembling step: The bottom layer rebars of the foundation slab, foundation steel columns, upper layer rebars of the foundation slab, and foundation rebars are pre-assembled in the factory, wherein the bottom layer rebar of the foundation slab comprises bottom layer sections and the first vertical sections that are connected with the bottom layer sections; the foundation steel column comprises columns and vertical pivot sections that are installed at the top of the column; the upper layer rebar of the foundation slab comprises the top layer sections, having a hollow section therewithin, and second vertical sections that are connected with the top layer sections; the foundation rebar comprises beams and columns, horizontal pivot sections that are installed at both ends of the beams and columns, and steel mesh structures installed above and below the beams and columns.
- an assembling step: The pre-assembled bottom layer rebars of the foundation slab, foundation steel columns, upper layer rebars of the foundation slab, and foundation rebars are delivered to the construction site. After the bottom layer rebars of the foundation slab are placed and fixed in position to the ground or spread footing, the foundation steel columns are positioned on the bottom layer rebars of the foundation slab; then the upper layer rebars of the foundation slab are positioned on the bottom layer rebars of the foundation slab, wherein the foundation steel columns penetrate through the hollow section of the upper layer rebars of the foundation slab; last, the foundation rebars are installed and penetrate through the sides of the foundation steel columns.
- a pivoting step: The pivot element is installed on the horizontal pivot section of the foundation rebar; the horizontal pivot sections of the foundation rebars are assembled using the pivot elements to connect to each other in order to form a pre-assembled raft foundation. Last, the outer part of the frame of the pre-assembled raft foundation is built with a formwork.
- a grouting step: Concrete is poured into the bottom layer rebars of the foundation slab, foundation steel columns, upper layer rebars of the foundation slab, and foundation rebars. After the concrete hardens, the construction of the foundation slab is completed.

Advantages of the multi-piece pre-assembled raft foundation and the construction method thereof include: pre-assembly of the bottom layer rebars of the foundation slab, foundation steel columns, upper layer rebars of the foundation slab, and foundation in the factory, so that construction workers can skip the step of tying rebars from the start; the construction time is significantly reduced; and the number of construction workers required can be less.

The above and other objects, features and advantages of the invention will become apparent from the following detailed description taken with the accompanying drawings

DETAILED DESCRIPTION OF THE INVENTION

Figure 1:
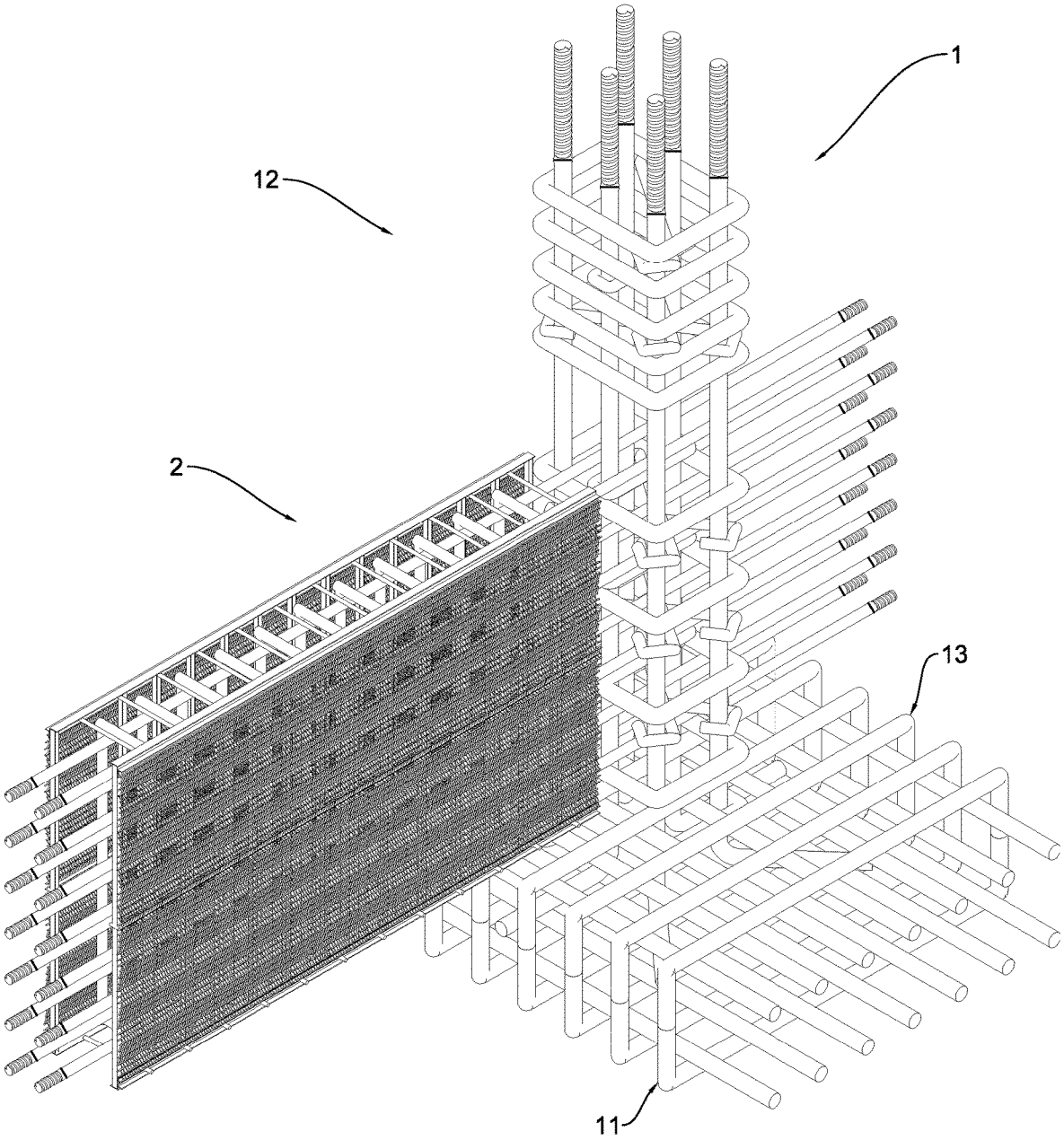
FIG. 1 is a schematic diagram of a pre-assembled raft foundation of the invention.
Figure 2:
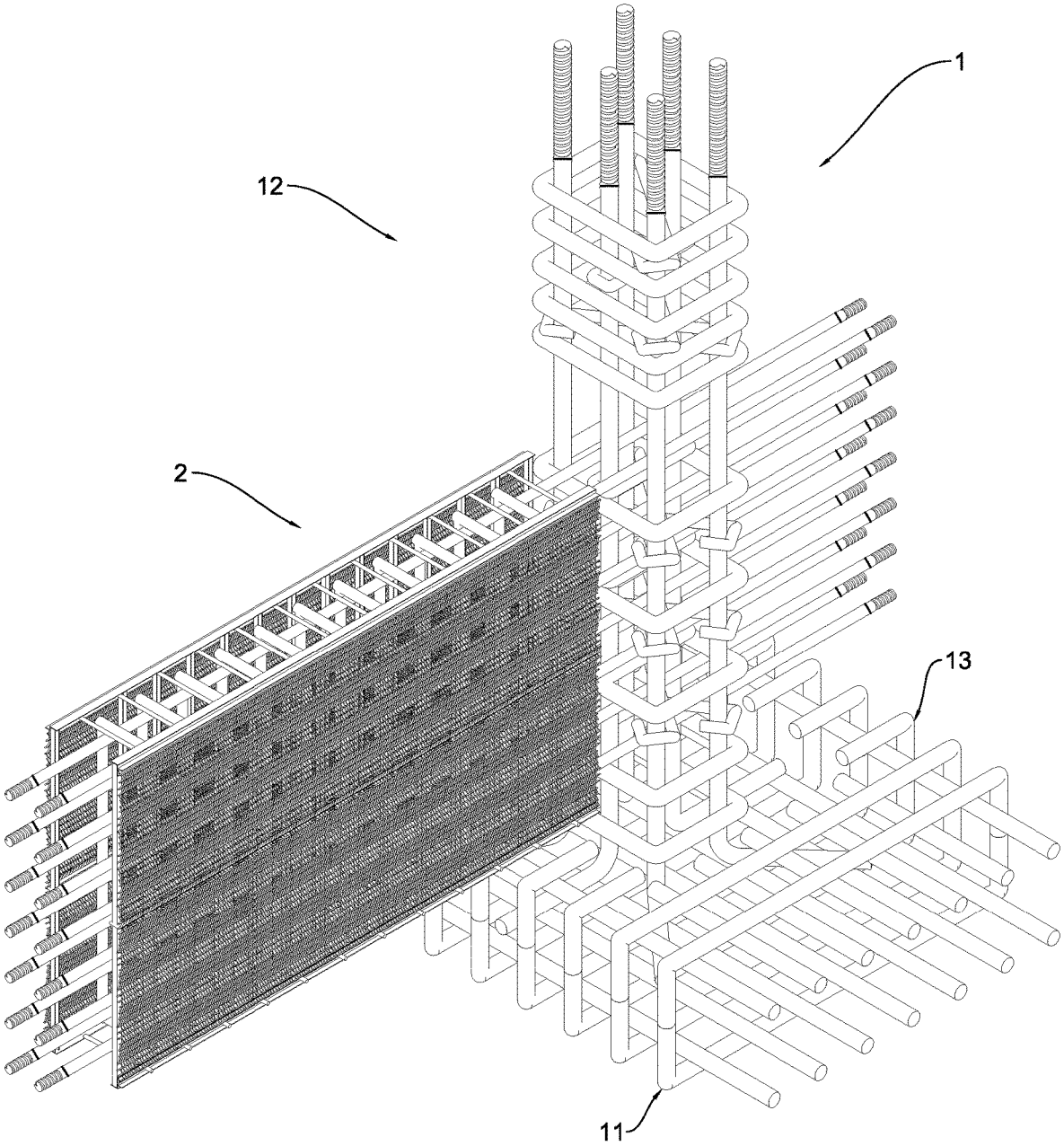
FIG. 2 is another schematic diagram of the pre-assembled raft foundation of the invention.

Referring to FIG. 1 and FIG. 2, a pre-assembled raft foundation 1 of the invention comprises the bottom layer rebars of the foundation slab 11, foundation steel columns 12, upper layer rebars of the foundation slab 13, and foundation rebars 2.

Figure 3:
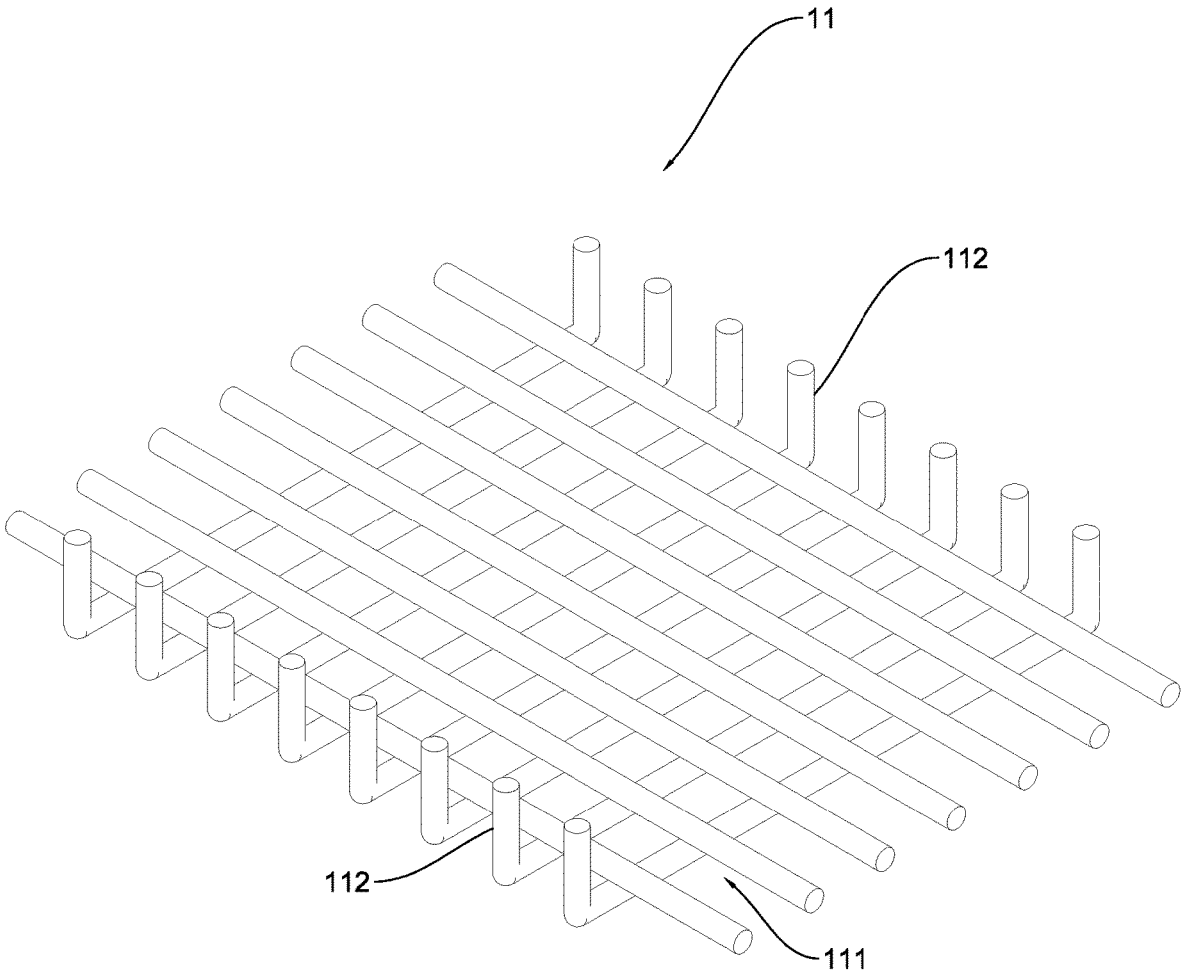
FIG. 3 a schematic diagram of the bottom layer rebars of the foundation slab of the invention.

Referring to FIG. 1 and FIG. 2 along with FIG. 3, the bottom layer rebars of the foundation slab 11 comprises bottom layer sections 111 and the first vertical sections 112 that are connected with the bottom layer sections 111; the bottom layer section 111 and the first vertical section 112 are composed of a plurality of U-shaped rebars and steel bars that are installed on the U-shaped rebars.

Figure 4:
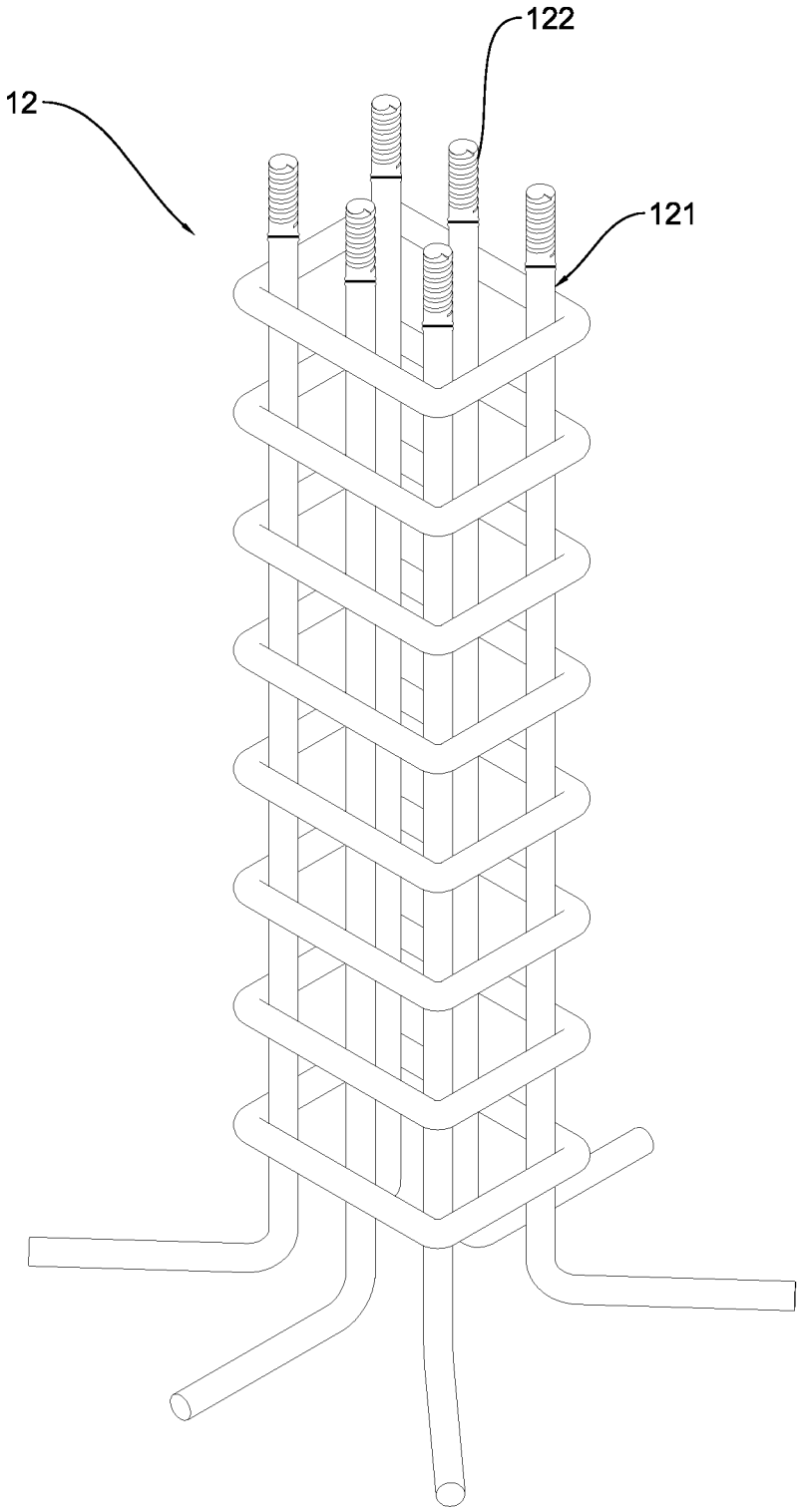
FIG. 4 a schematic diagram of the foundation steel columns of the invention.

Referring to FIG. 1 and FIG. 2 together with FIG. 4, the foundation steel columns 12 are installed on the bottom layer section 111 (as shown in FIG. 3), wherein the foundation steel column 12 comprises columns 121 and vertical pivot sections 122 that are installed at the top of the column 121.

Figure 5:
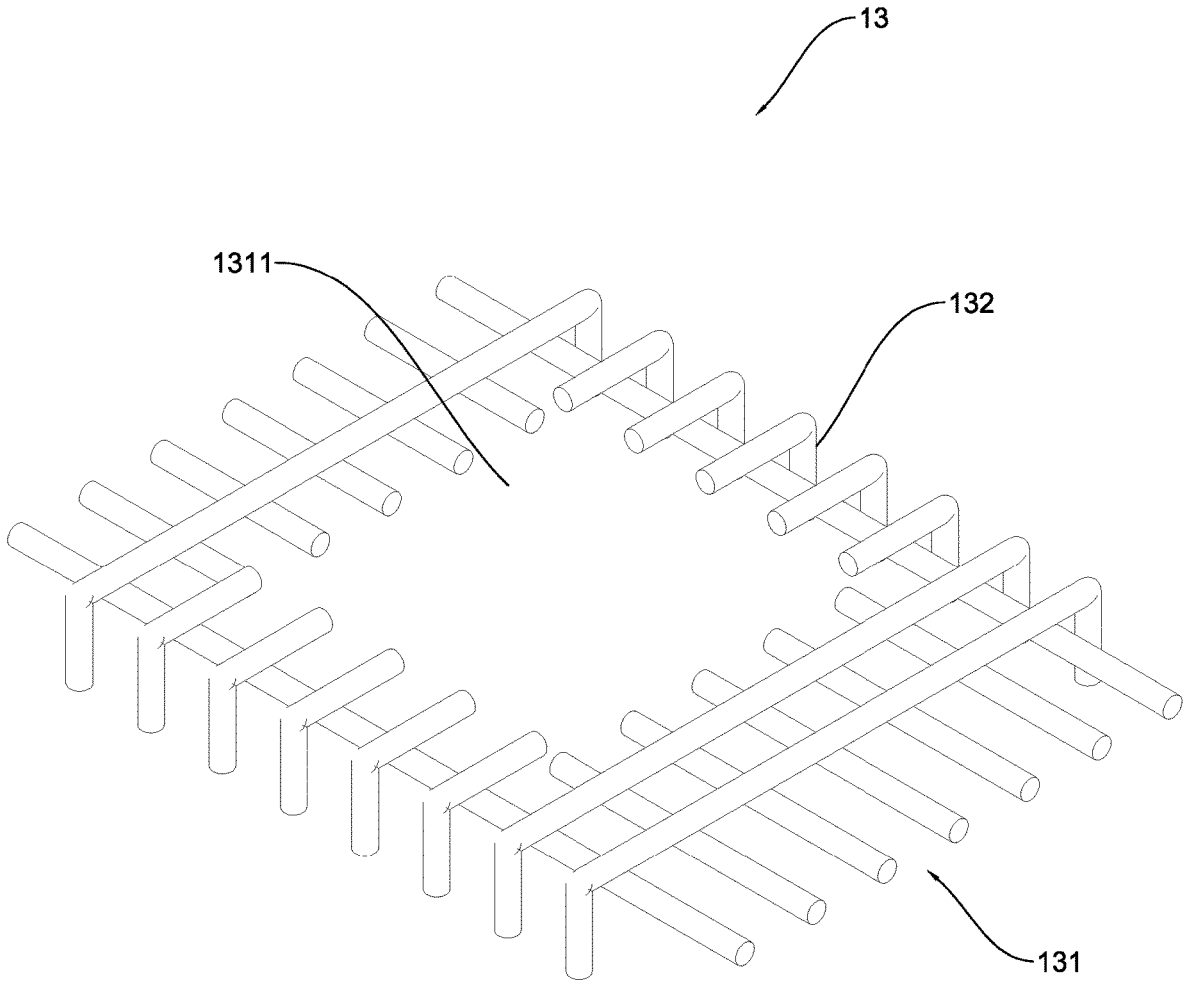
FIG. 5 a schematic diagram of the upper layer rebars of the foundation slab of the invention.

Referring to FIG. 1 and FIG. 2 together with FIG. 5, the upper layer rebars of the foundation slab 13 are installed on the bottom layer rebars of the foundation slab 11 (as shown in FIG. 3). The upper layer rebar of the foundation slab 13 comprises the top layer sections 131 and second vertical sections 132 that are connected with the top layer sections 131; the top layer section 131 and the second vertical section 132 are composed of a plurality of U-shaped rebars and steel bars that are installed on the U-shaped rebars, wherein the top layer section 1311 has a hollow section 1311 therewithin so that the foundation steel column can be installed therein; when the installation is completed, rebars are used to connect therewith, as show in FIG. 1.

Figure 6:
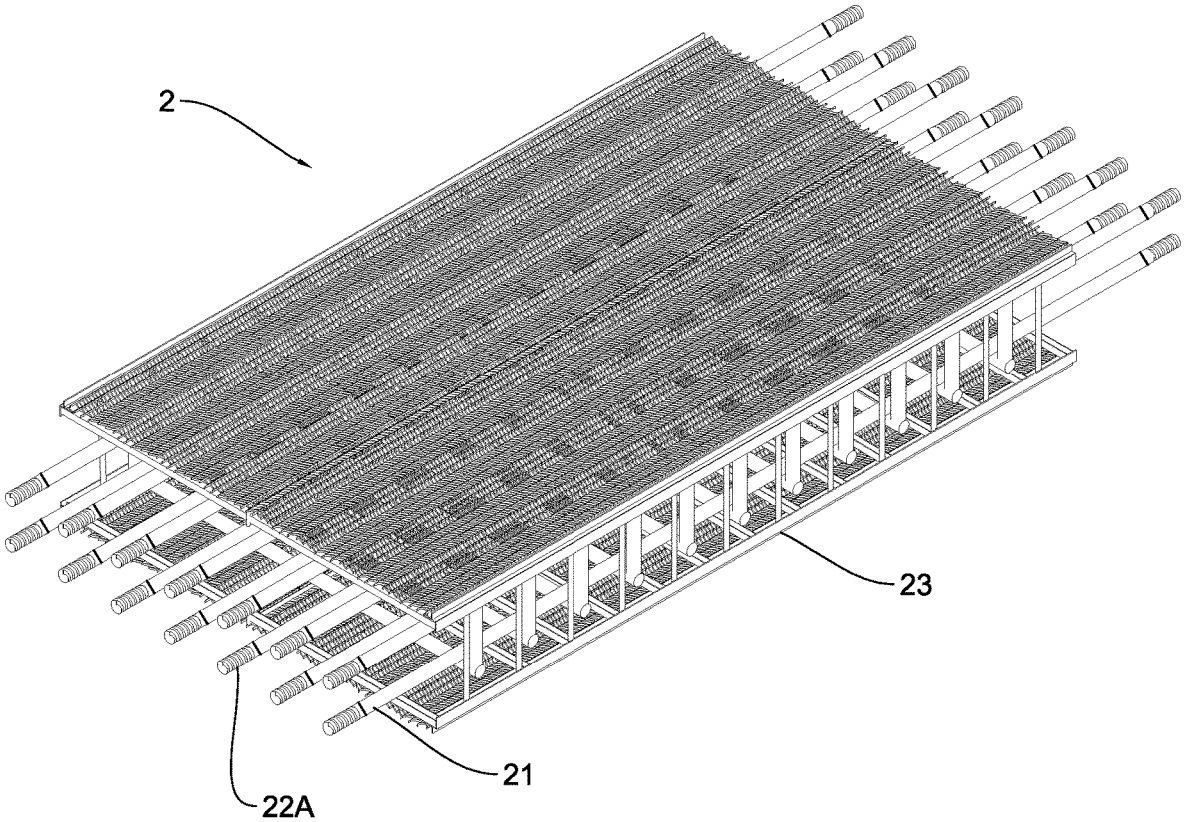
FIG. 6 a schematic diagram of the foundation rebars of the invention.
Figure 7:
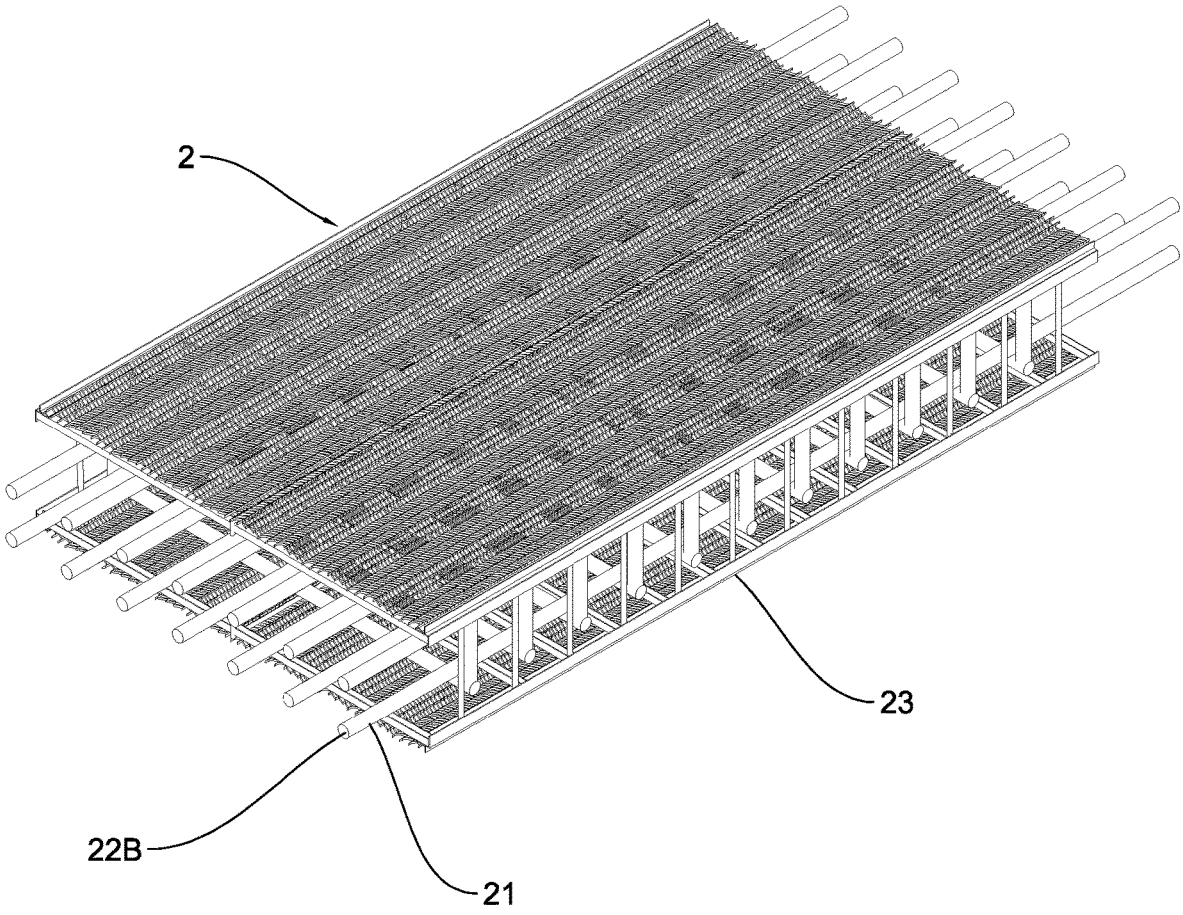
FIG. 7 another schematic diagram of the foundation rebars of the invention.

Referring to FIG. 1 and FIG. 2 together with FIG. 6 and FIG. 7, there is only one pivot element 5 is displayed for demonstration. However, a plurality of pivot elements 5 can be applied. The foundation rebar 2, installed on the side of the foundation steel columns 12, comprises a plurality of beams and columns 21, horizontal pivot sections 22A that are installed at both ends of the beams and columns 2, and steel mesh structures 23, wherein the plurality of beams and columns 21 are tied together by circular rebars and are secured by steel mesh structures 23 installed above and below the beams and columns 21.

Figure 10:
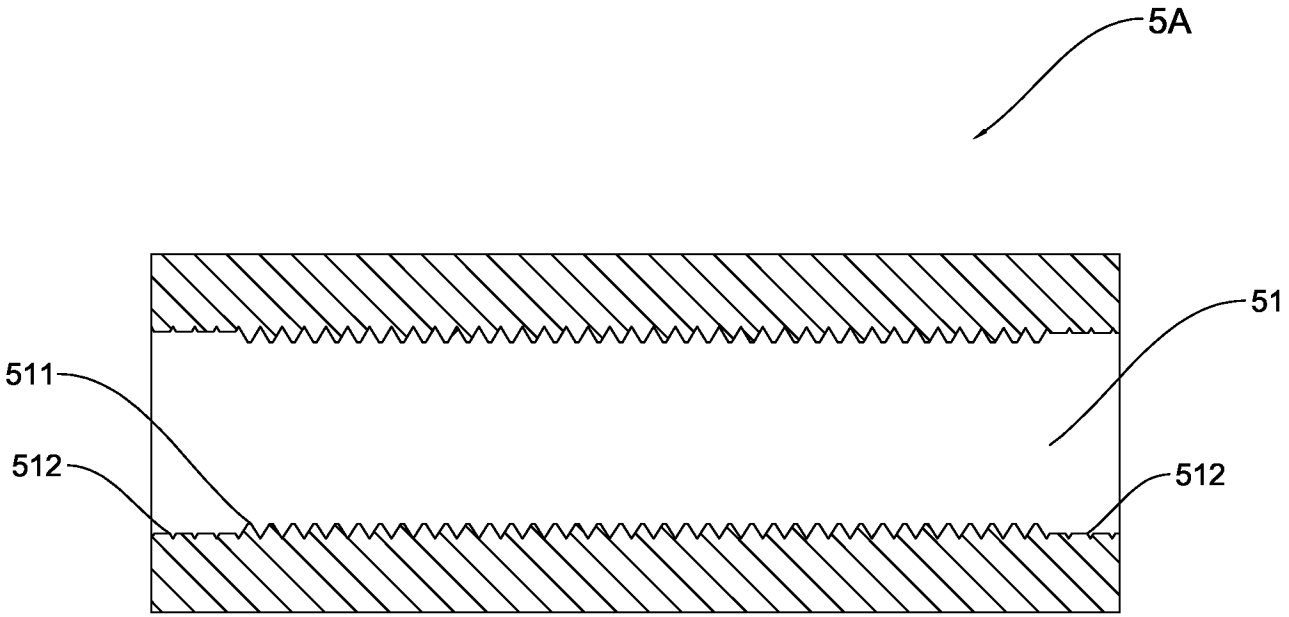
FIG. 10 is a schematic diagram of the first pivot element of the invention.
Figure 13:
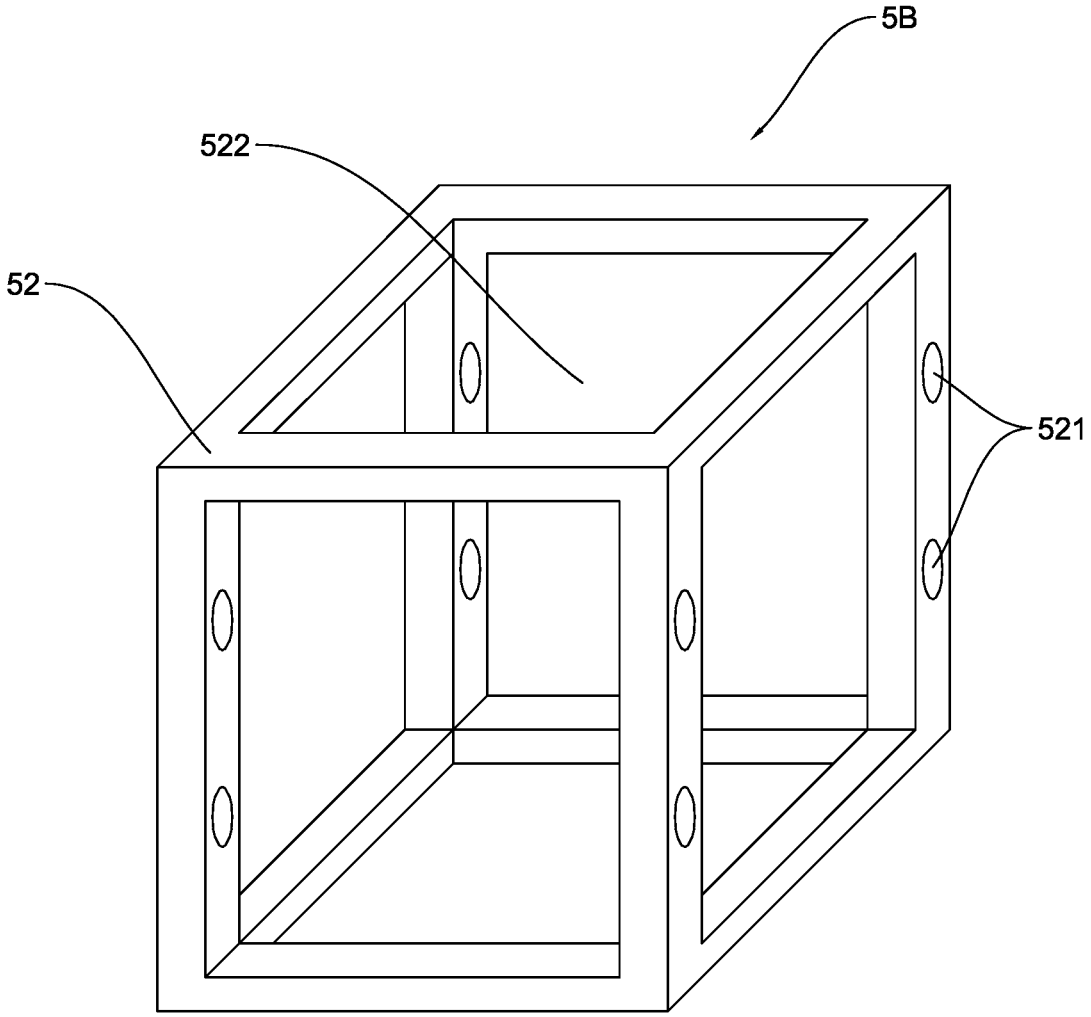
FIG. 13 is a schematic diagram of the second pivot element of the invention.
Figure 18:
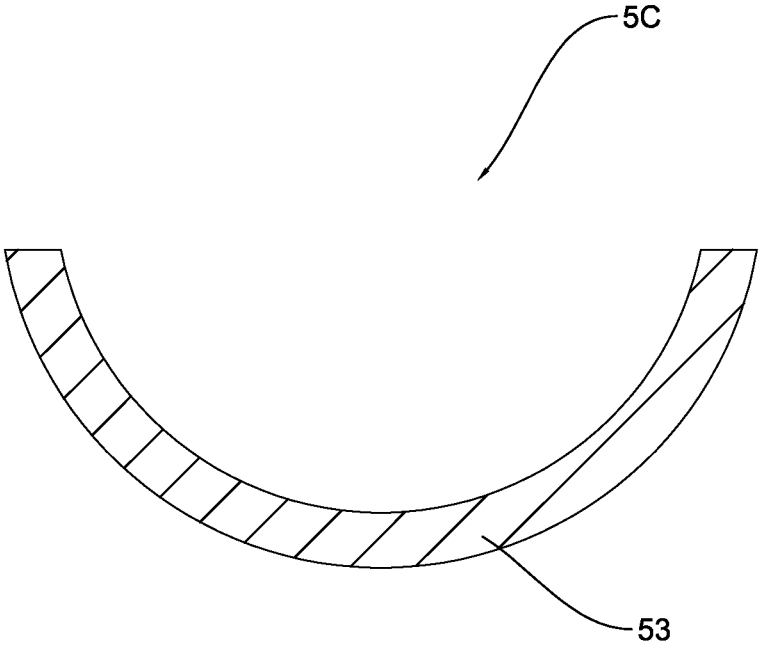
FIG. 18 is a schematic diagram of the third pivot element of the invention.
Figure 19:
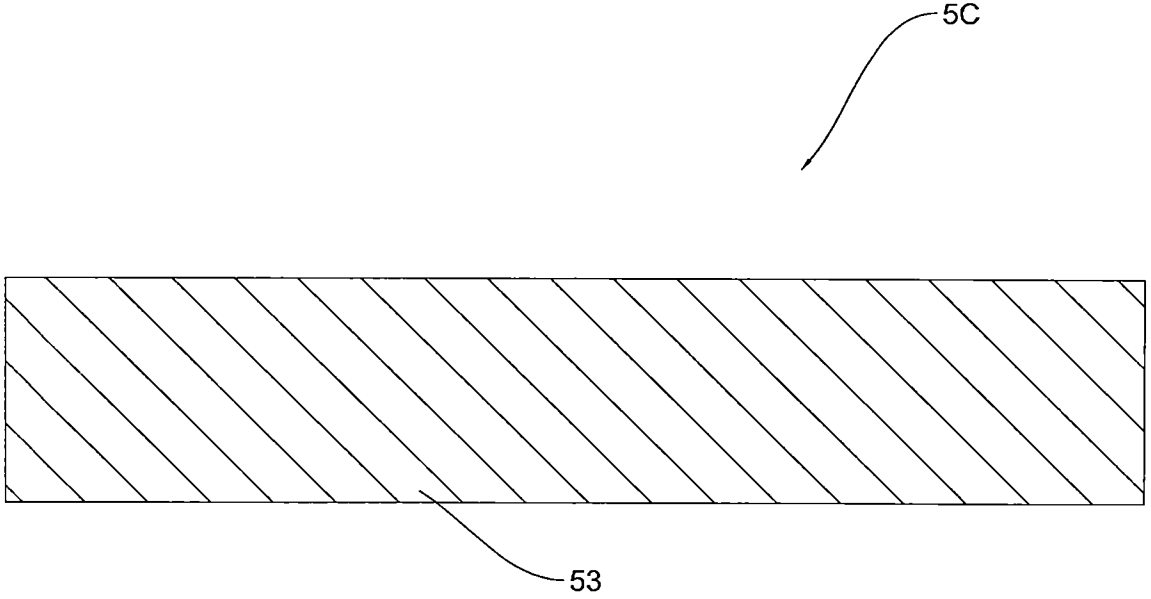
FIG. 19 is a schematic diagram of the third pivot element of the invention.
Figure 20:
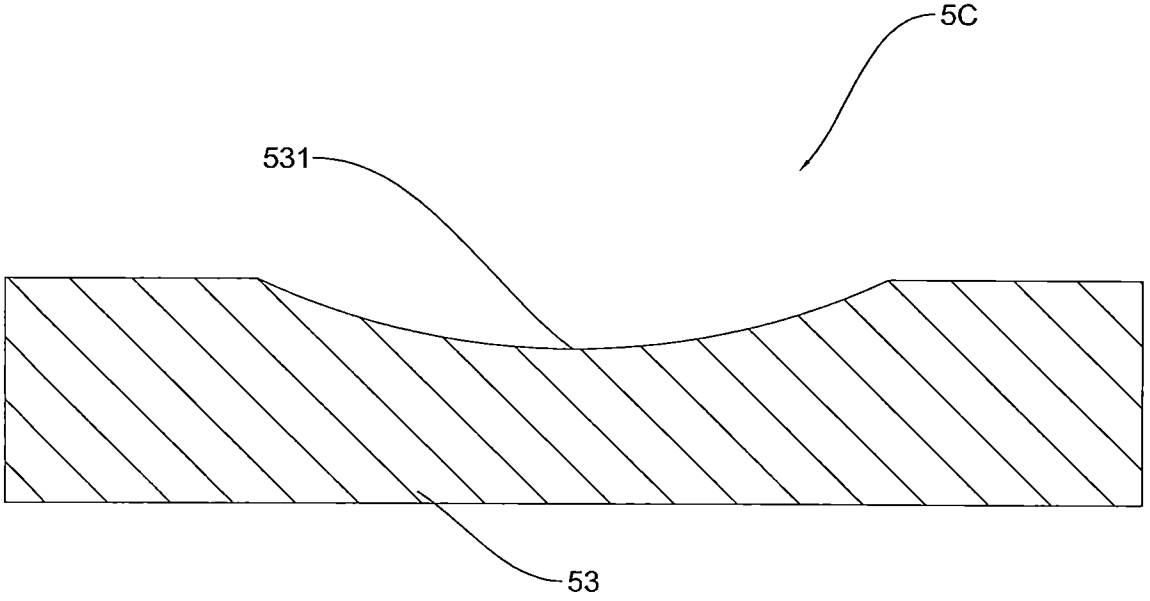
FIG. 20 is another schematic diagram of the third pivot element of the invention.
Figure 21:
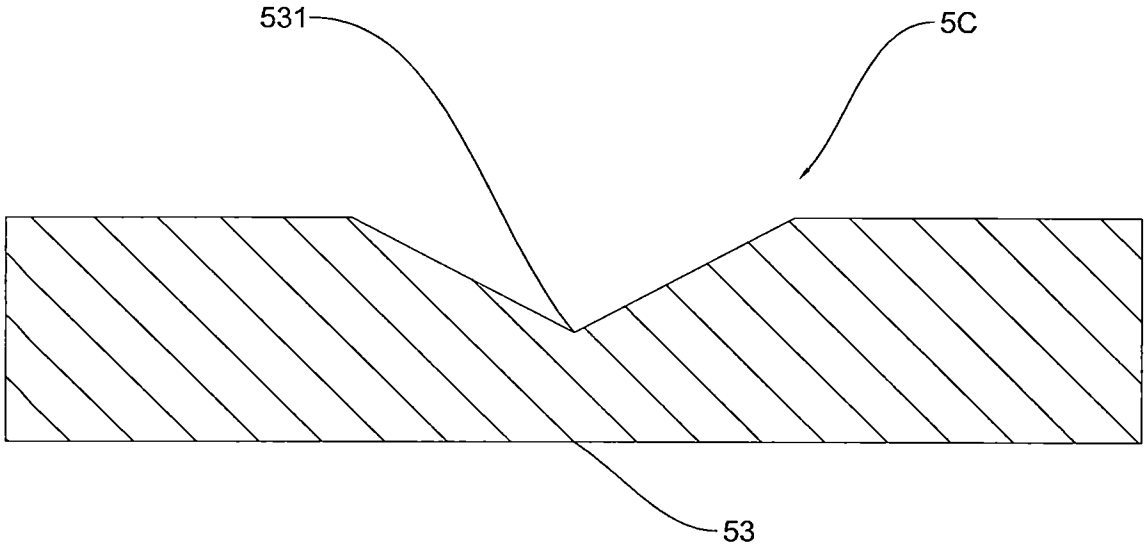
FIG. 21 is still another schematic diagram of the third pivot element of the invention.

The horizontal pivot sections 22A can have a form of a screw rod, or the horizontal pivot sections 22B can have a form of a cylinder, or other forms. Different forms are applied to different construction methods or to different pivot elements 5 for connection. In the embodiment of the invention, the pivot element 5 can be a first pivot element 5A (as shown in FIG. 10), or a second pivot element 5B (as shown in FIG. 13), or a third pivot element 5C (as shown in FIG. 18) for connecting and holding rebars in place.

The bottom layer rebars of the foundation slab 11 (as shown in FIG. 3), foundation steel columns 12 (as shown in FIG. 4), upper layer rebars of the foundation slab (as shown in FIG. 5), and foundation rebars are assembled to form a pre-assembled raft foundation 1.

Figure 8:
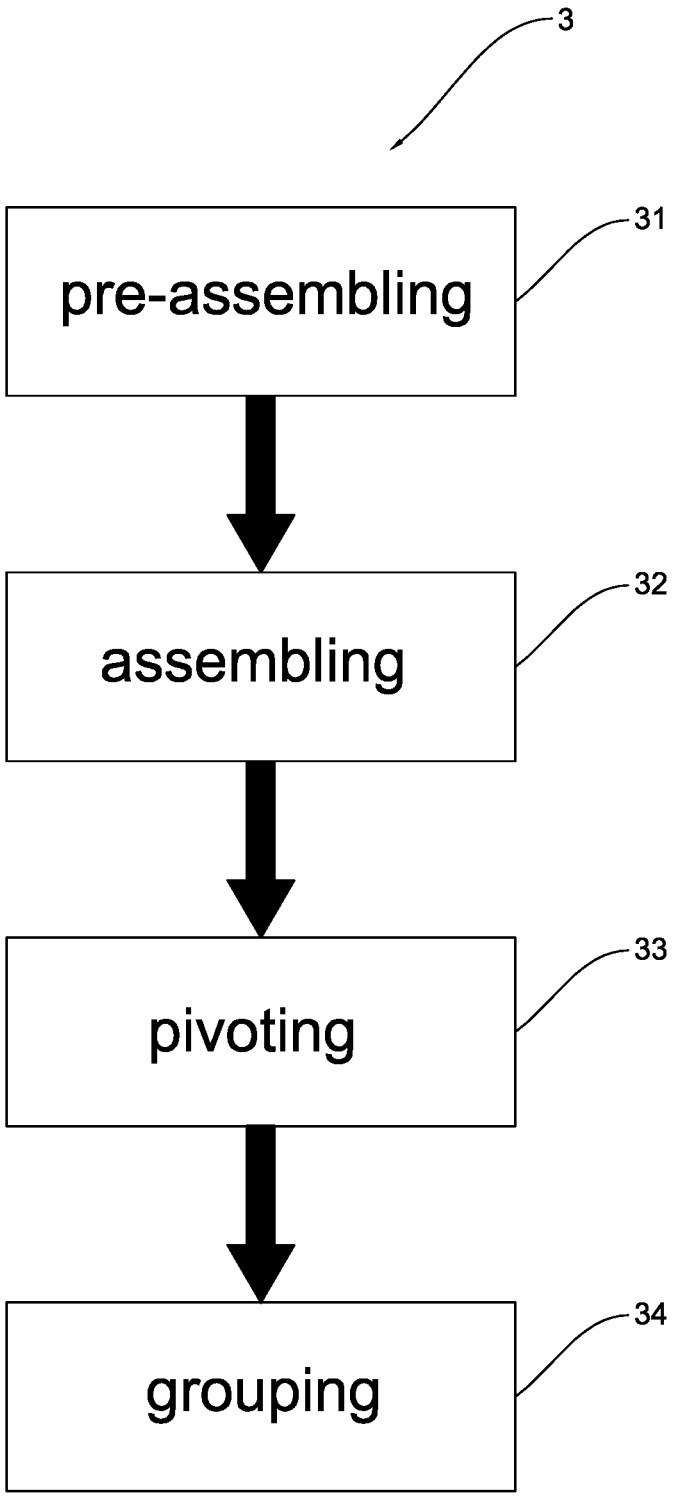
FIG. 8 is a construction flow diagram of the pre-assembled raft foundation of the invention.

Referring to FIG. 8 together with FIG. 1 to FIG. 7, the pre-assembled raft foundation construction method 3 of the invention comprises the following steps.

a pre-assembling step 31: Rebars are tied or welded into the structures of bottom layer rebars of the foundation slab 11, foundation steel columns 12, upper layer rebars of the foundation slab 13, and foundation rebars 2 in advance in the factory according to the dimensions required by the construction site, wherein the bottom layer rebar of the foundation slab 11 comprises bottom layer sections 111 and the first vertical sections 112 that are connected with the bottom layer sections 111; the foundation steel columns 12 comprises columns 121 and vertical pivot sections 122 that are installed at the top of the column 121; the upper layer rebar of the foundation slab 13 comprises the top layer sections 131, having a hollow section 1311 therewithin, and second vertical sections 132 that are connected with the top layer sections 131; the foundation rebar 2 comprises beams and columns 21, horizontal pivot sections 22A that are installed at both ends of the beams and columns 21, and steel mesh structures 23 installed above and below the beams and columns 21.

an assembling step 32: The pre-assembled bottom layer rebars of the foundation slab 11, foundation steel columns 12, upper layer rebars of the foundation slab 13, and foundation rebars 2 are delivered to the construction site. After the bottom layer rebars of the foundation slab 11 are placed and fixed in position to the ground or spread footing, the foundation steel columns 12 are positioned on the bottom layer rebars of the foundation slab 11; then the upper layer rebars of the foundation slab 13 are positioned on the bottom layer rebars of the foundation slab 11, wherein the foundation steel columns 12 penetrate through the hollow section 1311 of the upper layer rebars of the foundation slab 13; last, the foundation rebars 2 are installed and penetrate through the sides of the foundation steel columns 12.

a pivoting step 33: The pivot element 5 is installed on the horizontal pivot section 22A of the foundation rebar 2; two horizontal pivot sections 22A of the foundation rebars 2 that are in contact with each other are assembled using the pivot elements 5 to connect to each other in order to form a pre-assembled raft foundation 1. Last, the outer part of the frame of the pre-assembled raft foundation 1 is built with a formwork (not shown in the figure).

a grouting step 34: Wet concrete is poured into the bottom layer rebars of the foundation slab 11, foundation steel columns 12, upper layer rebars of the foundation slab 13, and foundation rebars 2. After the concrete hardens, the construction of the foundation slab is completed.

Furthermore, the formworks (not shown in the figure) used in the invention can be of timber, steel, etc. and are removable formworks (not shown in the figure). Non-removable formworks (not shown in the figure) can be used as well to replace the commonly available removable formworks (not shown in the figure).

Embodiments of the invention and relevant figures are described in details as follows.

Figure 9:
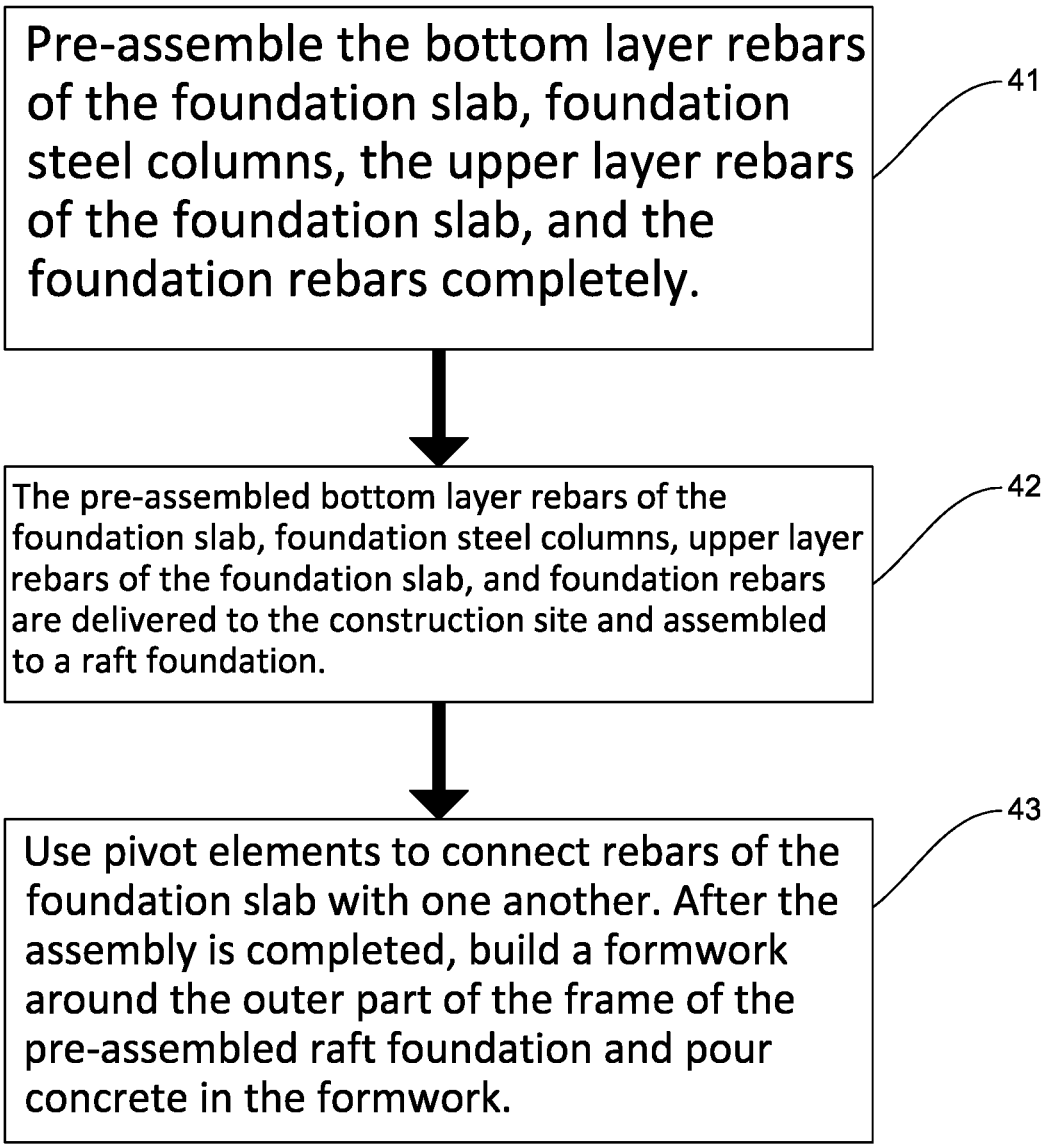
FIG. 9 is an implementation flow diagram of the invention.

Referring to FIG. 9, as explained in step 41, the bottom layer rebars of the foundation slab 11, foundation steel columns 12, upper layer rebars of the foundation slab 13, and foundation rebars 2 of the invention are manufactured in the factory in advance according to the dimensions of the specification issued by the construction site. Using the method of tying or welding, a plurality of U-shaped rebars, steel bars, stirrups, and tie bars are configured into the structures of bottom layer rebars of the foundation slab 11, foundation steel columns 12, upper layer rebars of the foundation slab 13, and foundation rebars 2.

As described in step 42 of FIG. 9, after the bottom layer rebars of the foundation slab 11, foundation steel columns 12, upper layer rebars of the foundation slab 13, and foundation rebars 2 are produced, the aforementioned parts can be shipped directly to the construction site for assembly. Once the aforementioned parts arrive at the construction site, workers at the construction site simply place and fix the bottom layer rebars of the foundation slab 11 in position to the ground or spread footing, place the foundation steel columns 12 on the bottom layer rebars of the foundation slab 11, lay down the upper layer rebars of the foundation slab 13 on the bottom layer rebars of the foundation slab 11 and make the foundation steel columns 12 penetrate through the hollow sections 1311, and finally install the foundation rebars 2 to penetrate through the sides of the foundation steel columns 12. Construction workers repeat the aforementioned assembling steps so that the horizontal pivot sections 22A of the foundation rebars 2 and the foundation steel columns 12 are assembled to connect to each other. Last, after the hollow section 1311 is filled with steel bars, the assembly process is completed.

As described in step 43 of FIG. 9, after the assembly process is completed, construction workers can install the pivot elements 5 on the horizontal pivot sections 22A, making the horizontal pivot sections 22A of the foundation rebars 2 be connected to each other as one piece to form a raft foundation. Next, after the outer part of the frame of the raft foundation is installed with a formwork (not shown in the figure), wet concrete is poured in the formwork. When concrete is cured and hardens, the pre-assembled raft foundation construction method of the invention is completed.

Furthermore, the pivot element 5 used in the invention can be one of the following three forms. The first form is a first pivot element 5A (as shown in FIG. 10); the second form is a second pivot element 5B (as show in FIG. 13), and the third form is a third pivot element 5C. Descriptions of the aforementioned pivot elements 5 are provided in detail.

The first form of the pivot element 5 is a first pivot element 5A:

Referring to FIG. 10 together with FIG. 6, the first pivot element 5A has a through hole 51, having an internal thread 511 through the internal surface of the through hole 51. Both ends of the first pivot element 5A are connected with the horizontal pivot sections 22A, making two foundation rebars 2 to be bound to each other. In addition, both ends of the internal thread 511 of the first pivot element 5A have an internal guide section 512 separately. The design of the internal guide section 512 allows the horizontal pivot section 22A to insert into the through hole 51 more easily. The first pivot element 5A can be with multiple-start threads, for example, two-start threads, three-start threads, or multi-start threads. The threads of the internal guide section 512 and the horizontal pivot section 22A can be right-hand threads of the same direction, or left-hand threads of the same direction, or right-hand and left-hand threads of different directions.

Figure 11:
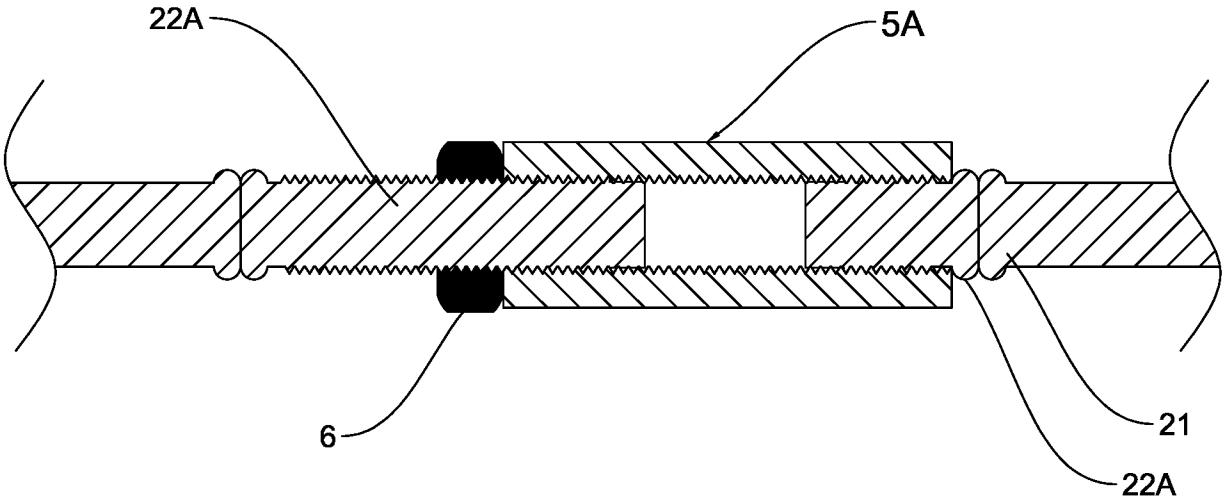
FIG. 11 is a schematic diagram of an embodiment of the first pivot element of the invention.

Referring to FIG. 11, a single mounting element 6 is installed on any one of the two horizontal pivot sections 22A. Next, the first pivot element 5A is installed on one of the horizontal pivot sections 22A and then the other horizontal pivot sections 22A is inserted into the first pivot element 5A for fastening. The first pivot element 5A is rotated to gradually fasten these two horizontal pivot sections 22A together toward the first pivot element 5A. Last, the mounting element 6 is fastened to eliminate the gap between the first pivot element 5A and the two horizontal pivot sections 22A.

In respect to the aforementioned fastening process, the first pivot element 5A and the horizontal pivot sections 22A can be with multi-start threads, for example, two-start threads, three-start threads, or multi-start threads. The threads of the internal guide section 512 and the horizontal pivot sections 22A can be right-hand threads of the same direction, or left-hand threads of the same direction. Therefore, the first pivot element 5A can rotate to fine-tune the lock mounting position when the lock mounting distance remains unchanged, and then a single mounting element 6 is used to lock the position of the first pivot element 5A.

On the contrary, the aforementioned internal guide section 512 and the horizontal pivot section 22A can also be with right-hand and left-hand threads of different directions. In other words, the internal guide section 512 has right-hand threads and the horizontal pivot sections 22A have left-hand threads, or the internal guide section 512 has left-hand threads and the horizontal pivot sections 22A have right-hand threads. Thus, when the first pivot element 5A is rotated, the lock mounting distance will change, whereas the lock mounting position remains unchanged. Last, the adjusted first pivot element 5A is locked and mounted at the position using a single mounting element 6.

Figure 12:
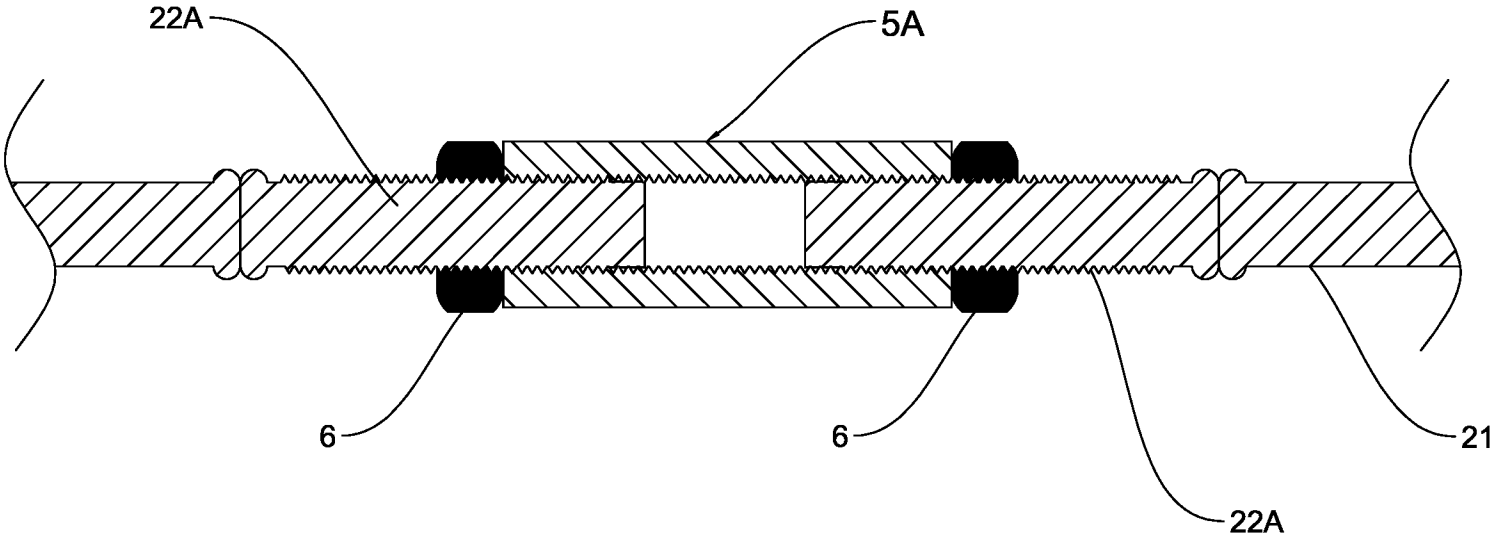
FIG. 12 is another schematic diagram of the embodiment of the first pivot element of the invention.

Referring to FIG. 12, while using the first pivot element 5A, the horizontal pivot sections 22A of two foundation rebars 2 that are set to be fastened to each other can be installed with a mounting element 6 separately in advance. Next, a first pivot element 5A is installed on one of the horizontal pivot sections 22A and then the other horizontal pivot sections 22A to be connected is aligned to the first pivot element 5A for fastening. The first pivot element 5A is rotated to gradually fasten these horizontal pivot sections 22A together toward the first pivot element 5A. Last, the mounting elements 6 placed at both ends of the first pivot element 5A separately to eliminate the gaps among the two horizontal pivot sections 22A, the first pivot element 5A and the beams and columns.

In respect to the aforementioned fastening process, the first pivot element 5A and the horizontal pivot sections 22A can be with multi-start threads, for example, two-start threads, three-start threads, or multi-start threads. The threads of the internal guide section 512 and the horizontal pivot sections 22A can be right-hand threads or left-hand threads of the same direction. Therefore, the first pivot element 5A can rotate to fine-tune the lock mounting position when the lock mounting distance remains unchanged, and then two mounting elements 6 are used to lock the position of the first pivot element 5A.

On the contrary, the aforementioned internal guide section 512 and the horizontal pivot section 22A can also be with right-hand and left-hand threads of different directions. In other words, the internal guide section 512 has right-hand threads and the horizontal pivot sections 22A have left-hand threads, or the internal guide section 512 has left-hand threads and the horizontal pivot sections 22A have right-hand threads. Thus, when the first pivot element 5A is rotated, the lock mounting distance will change, whereas the lock mounting position remains unchanged. Last, the adjusted first pivot element 5A is locked and mounted at the position using two mounting elements 6.

The second form of the pivot element 5 is a second pivot element 5B:

Referring to FIG. 13 together with FIG. 6, the second pivot element 5B is a frame body 52, wherein the frame body 52 has a plurality of positioning holes 521 thereon, for the horizontal pivot sections 22A to insert, and a containing space 522 that is connected through the positioning holes 521. The second pivot element 5B, installed in the containing space 522, holds up the mounting element 6 to be set on the horizontal pivot sections 22A, so that the horizontal pivot sections 22A are mounted on the frame body 52.

Figure 14:
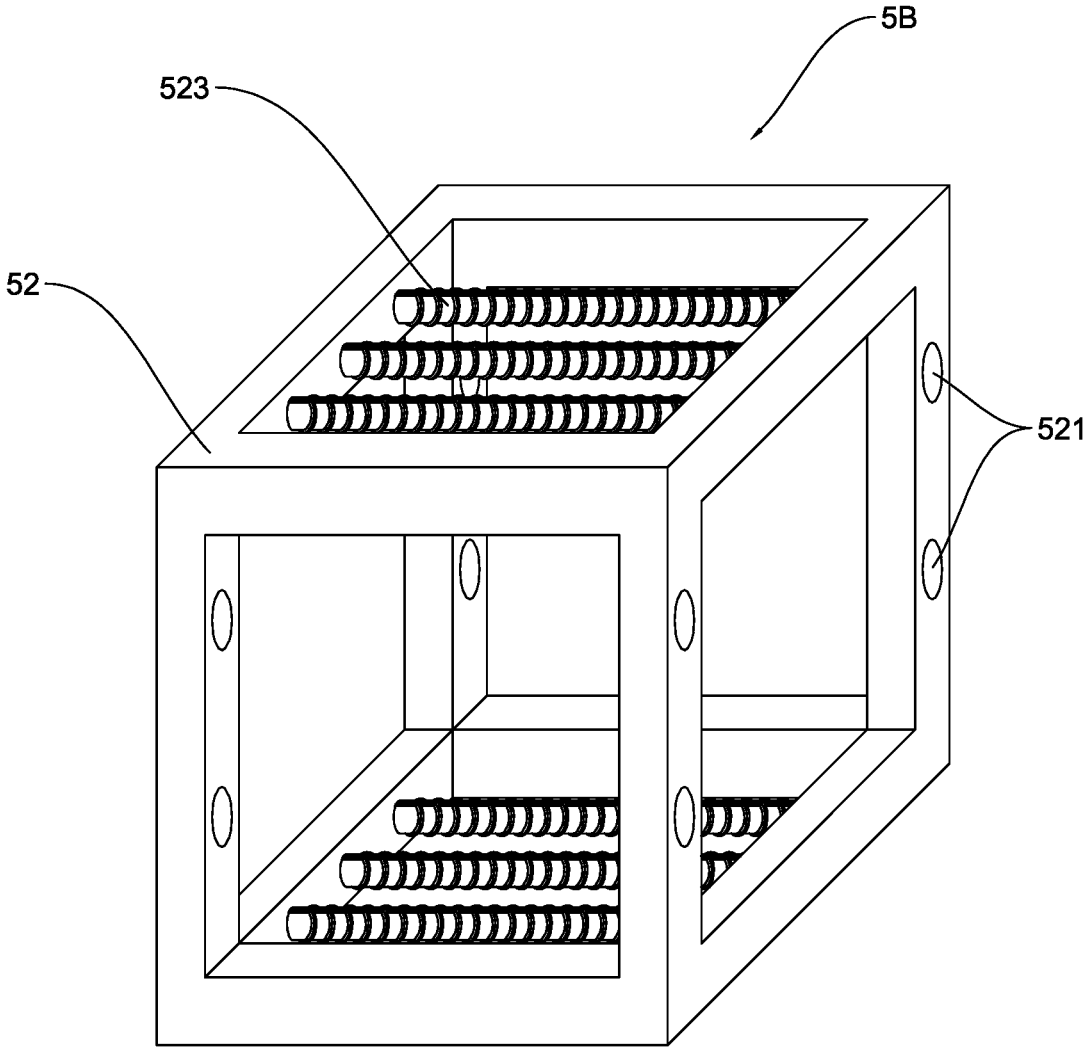
FIG. 14 another schematic diagram of the second pivot element of the invention.

Referring to FIG. 14 together with FIG. 6, to increase the overall strength of the second pivot element 5B, enhancing elements 523, parallel to the positioning holes 521, can be added to the frame body 52 to make the second pivot element 5B more solid and stronger.

Figure 15:
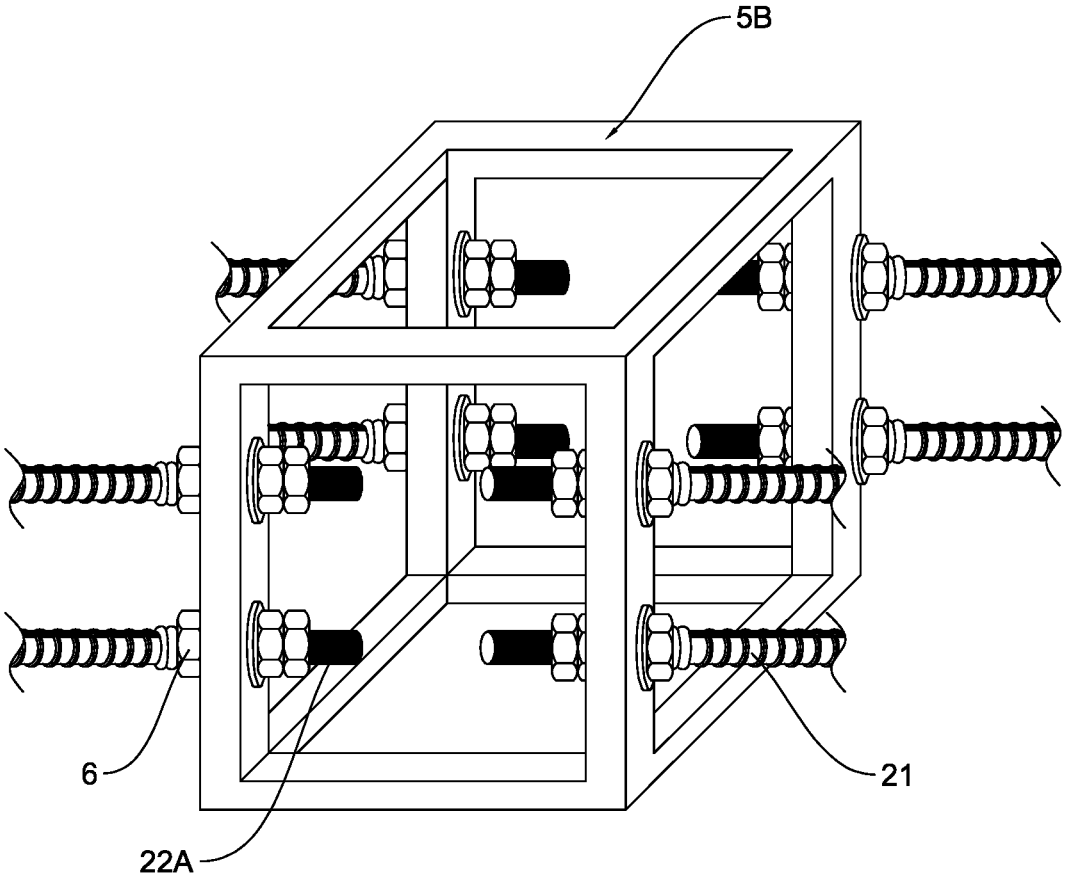
FIG. 15 a schematic diagram of an embodiment of the second pivot element of the invention.
Figure 16:
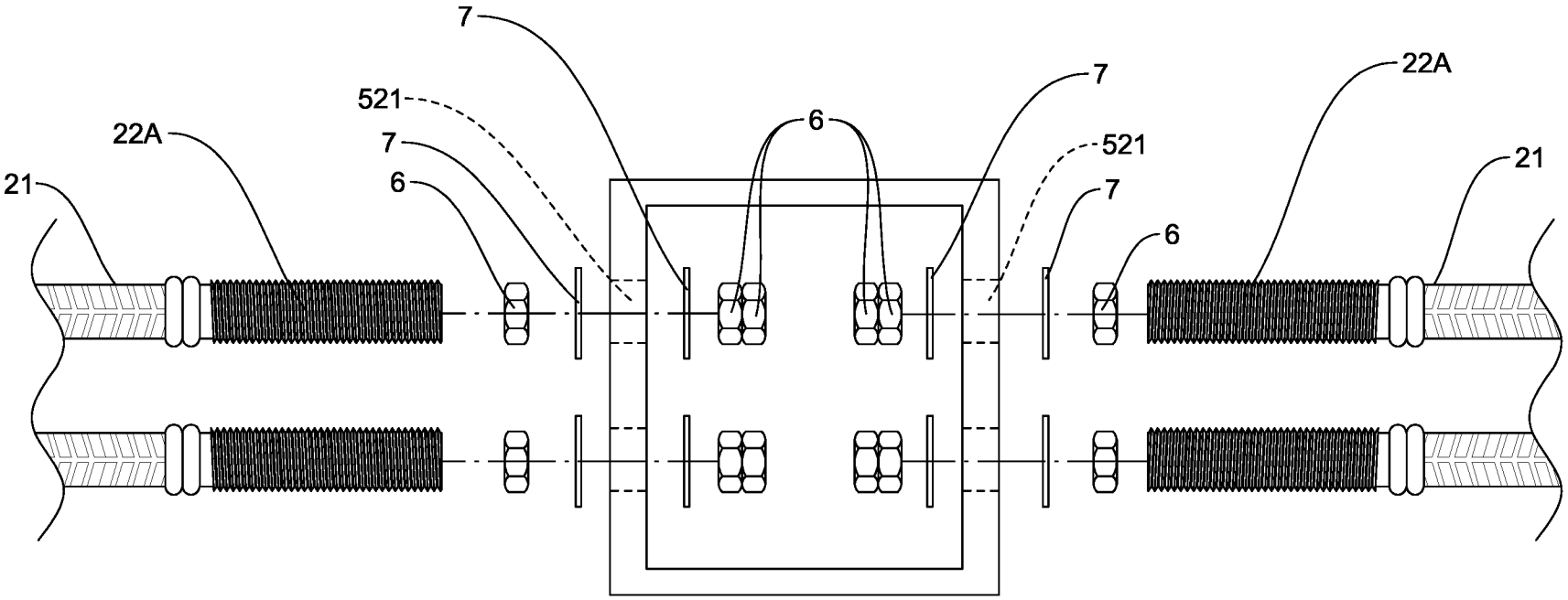
FIG. 16 another schematic diagram of the embodiment of the second pivot element of the invention.

Referring to FIG. 15 and FIG. 16, to fasten the foundation steel columns 12 and the foundation rebars 2, the second pivot elements 5B can be used to connect the foundation rebars 2 that penetrate the foundation steel columns 12. Before the second pivot elements 5B are used, the mounting elements 6 and washers 7 are installed on the horizontal pivot sections 22A. Next, after the positioning holes 521 of the frame body 52 are aligned with the horizontal pivot sections 22A, the second pivot elements 5B are inserted into the horizontal pivot sections 22A, followed by installing the mounting elements 6 and washers 7 to the horizontal pivot sections 22A again. Last, all mounting elements 6 are fastened.

Figure 17:
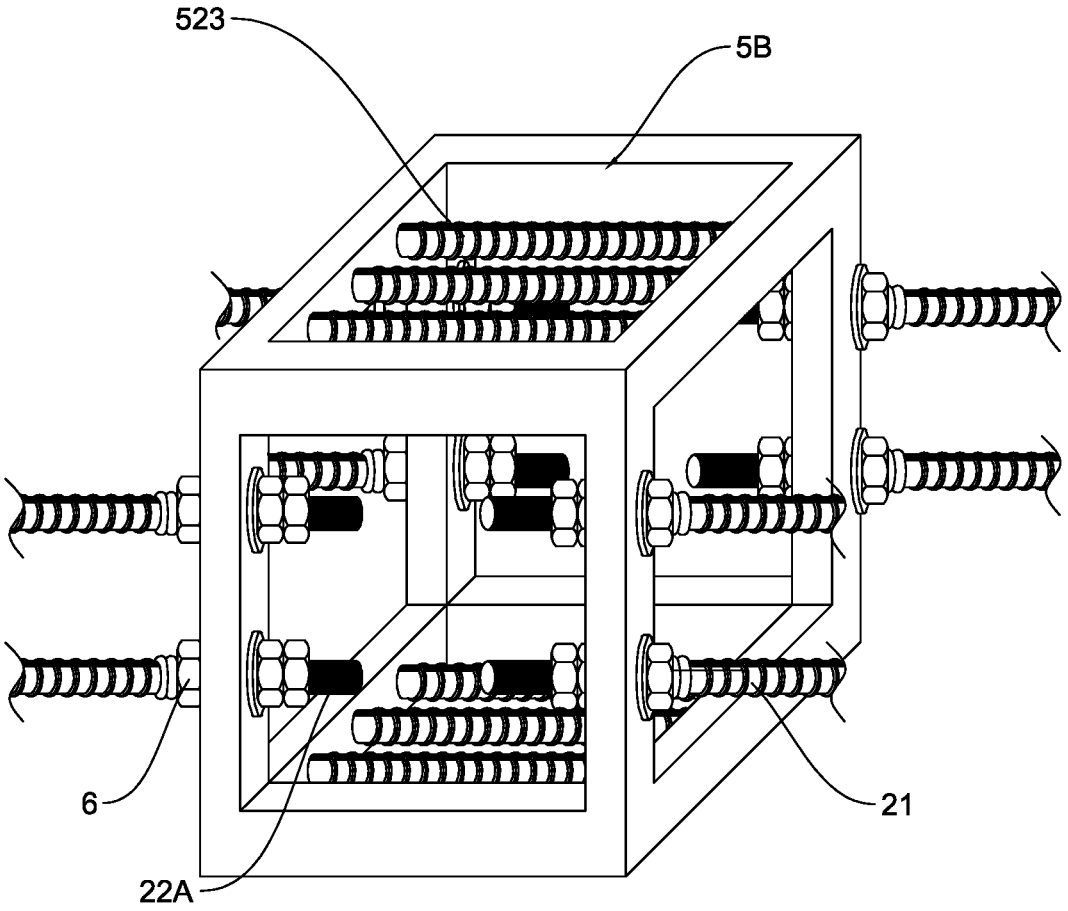
FIG. 17 is a schematic diagram of an embodiment of the second pivot element of the invention.

Referring to FIG. 17, in addition to the second pivot elements 5B being used to connect two foundation rebars 2 and the foundation steel columns 12, enhancing elements 523 are added. The installation process is the same as the previous descriptions. Before the second pivot elements 5B are used, the mounting elements 6 and washers 7 are installed on the horizontal pivot sections 22A. Next, after the positioning holes 521 of the frame body 52 are aligned with the horizontal pivot sections 22A, the second pivot elements 5B are inserted into the horizontal pivot sections 22A, followed by installing the mounting elements 6 and washers 7 to the horizontal pivot sections 22A again. Last, all mounting elements 6 are fastened. The third form of the pivot element 5 is a third pivot element 5C:

Referring to FIG. 18 to FIG. 21, together with FIG. 7, the third pivot element 5C is a backing plate 53 made of carbon-based materials, wherein the backing plate 53 is installed on the back of two horizontal pivot sections 22B of the foundation rebars 2 respectively, to fasten these two horizontal pivot sections 22B of the foundation rebars 2 by welding. The backing plate 53 can withstand a high temperature of over 1500° C.; the cross section of the backing plate 53 has an arc shape or a flat shape, or is a flat plate with a groove 531.

Furthermore, when the aforementioned three different forms of pivot element 5 are assembled, there are different forms of assembly. The assembly methods of the first pivot element 5A, the second pivot element 5B, and the third pivot element 5C are described separately as follows.

The assembly method of the first pivot element 5A.

Figure 22:
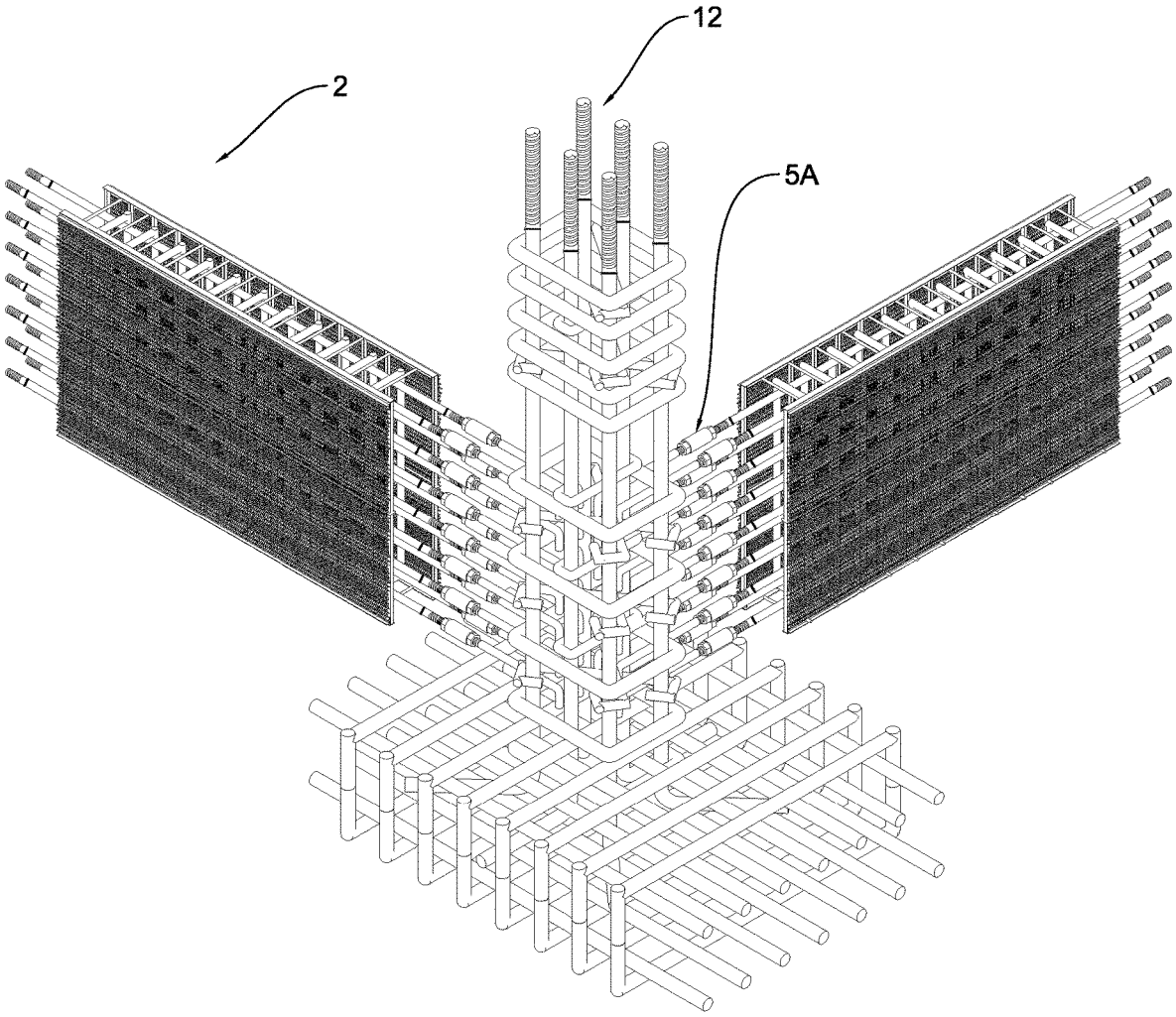
FIG. 22 is a schematic diagram of the assembly of the first pivot elements of the invention.

Referring to FIG. 22, place all first pivot elements 5A on the same plane with the horizontal pivot sections 22A, or place all first pivot elements 5A on different planes with the horizontal pivot sections 22A in an interlacing way. The advantage of adopting an interlacing form is to prevent the horizontal pivot sections 22A and the beams and columns 21 to break up simultaneously upon impact.

A foundation rebar 2 reaching foundation steel column 12 in the horizontal direction is picked as the standard; the same applies to another foundation rebar 2 that reaches a foundation steel column 12 in the vertical direction. If the length of beams and columns 21 of the foundation rebar 2 is not long enough, the beams and columns 21 can be extended with combining steel bars connected by the first pivot elements 5A. Therefore, two foundation rebars 2 can extend and insert into the foundation steel column 12 while these two foundation rebars 2 are connected to each other.

Figure 23:
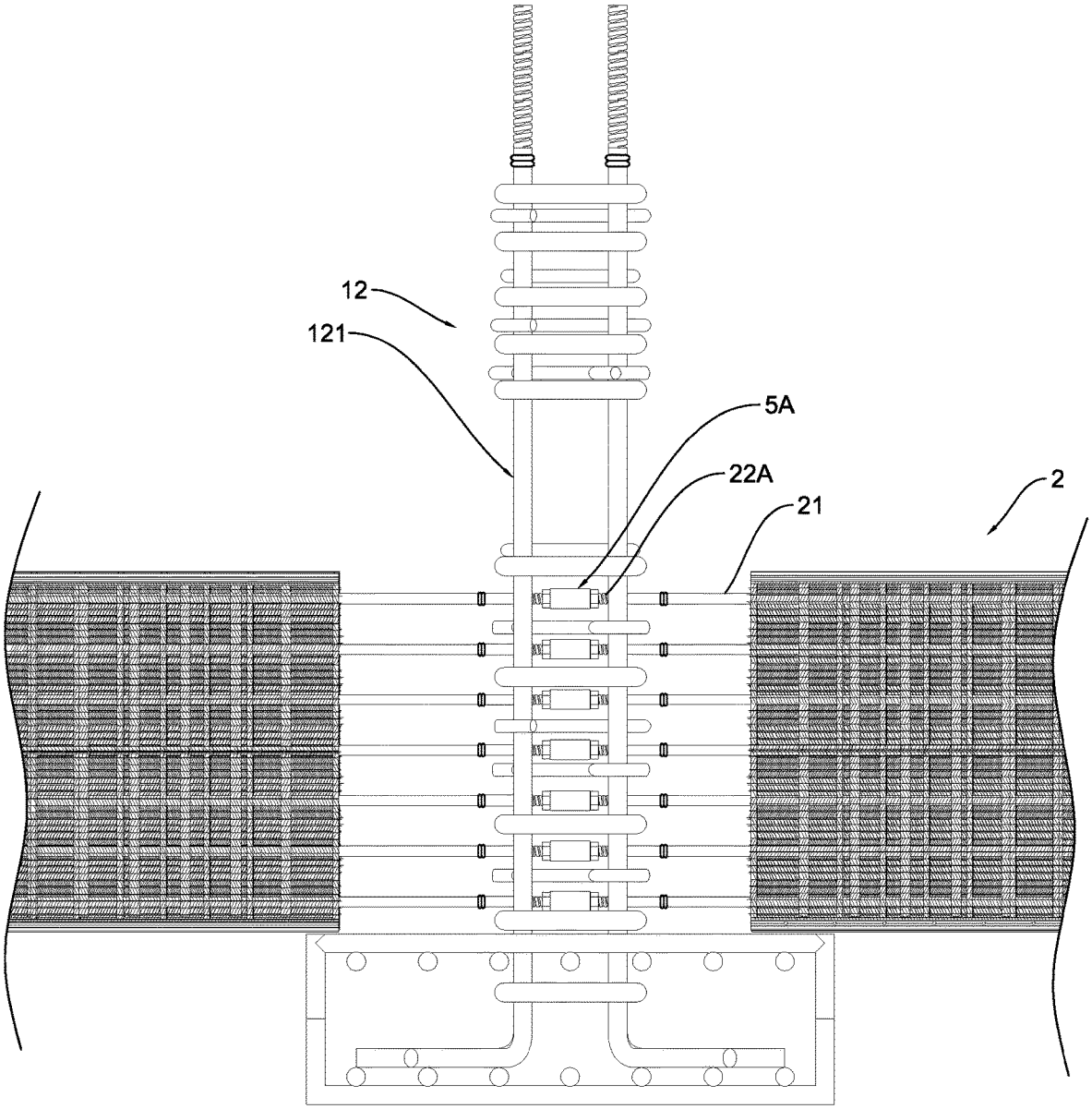
FIG. 23 is another schematic diagram of the assembly of the first pivot elements of the invention.
Figure 24:
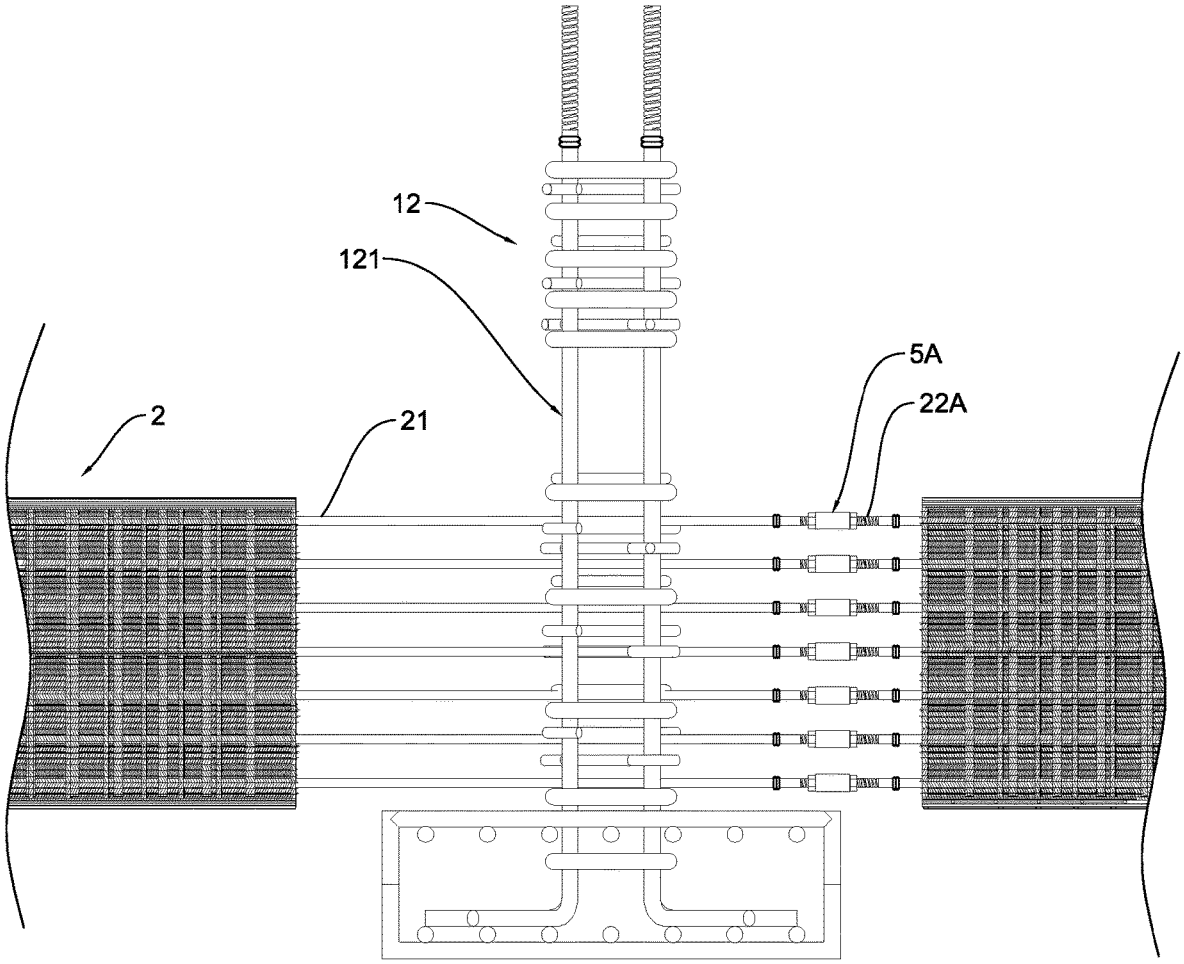
FIG. 24 is still another schematic diagram of the assembly of the first pivot elements of the invention.
Figure 25:
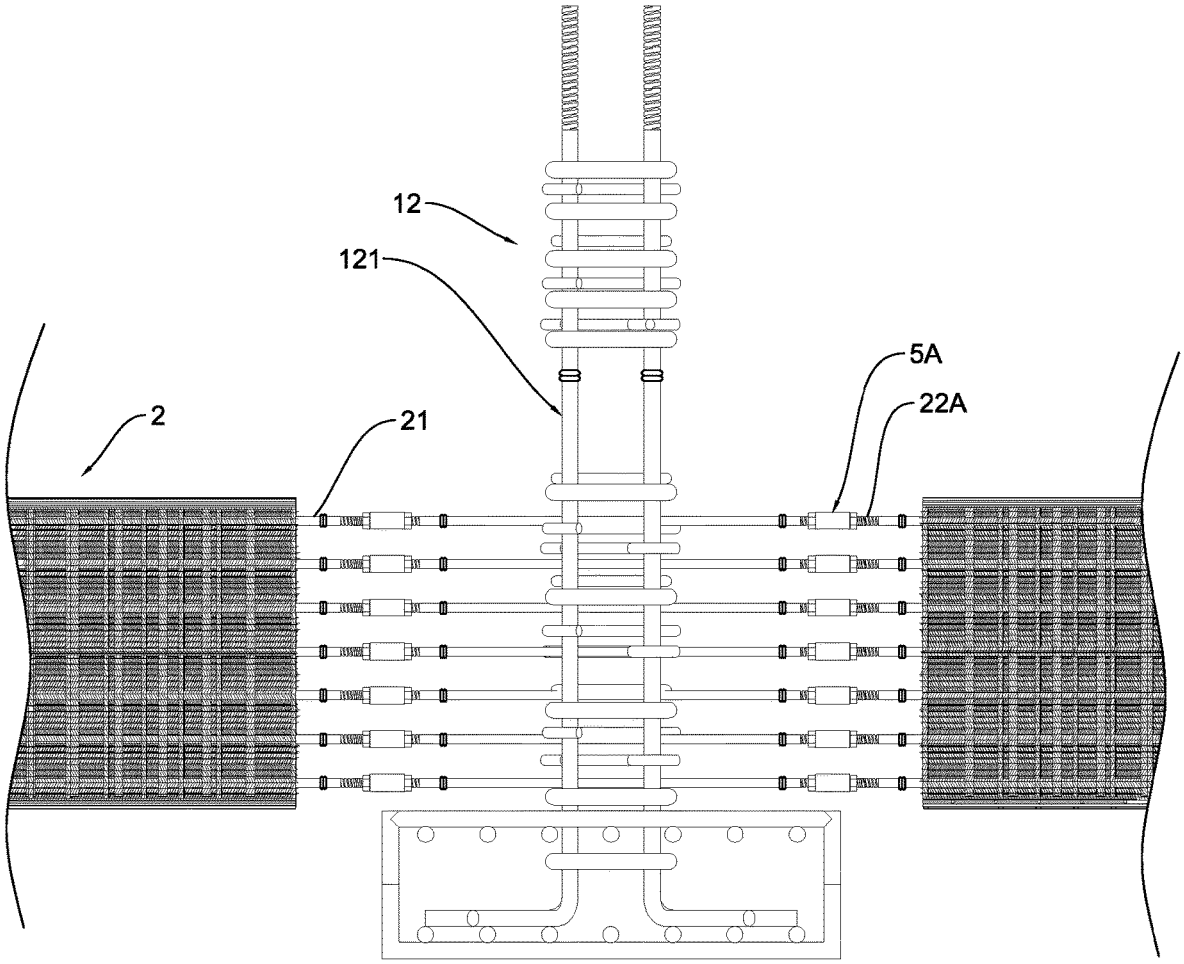
FIG. 25 is yet another schematic diagram of the assembly of the first pivot elements of the invention.

Referring to FIG. 23, FIG. 24, and FIG. 25, the location of the connection joint of the first pivot element 5A can be inside the foundation steel columns 12 and a proper location on the side of the foundation steel columns 12. The beams and columns 21 of two foundation rebars 2 penetrate through the foundation steel columns 12, and are connected and fastened with the horizontal pivot sections 22A within the foundation steel columns 12 using the first pivot elements 5A. This process is a connection method of column-foundation (inside of column) (as shown in FIG. 23). The same connecting and fastening operation can be applied to a proper location on the side of the foundation steel columns 12. A foundation rebar 2 is inserted horizontally through the foundation steel column 12 and the horizontal pivot section 22A is in contact with the horizontal pivot section 22A of another foundation rebar 2. A first pivot element 5A is used to connect these two horizontal pivot section 22A separately. This process is a connection method of column-foundation (outside of column) (as shown in FIG. 24). The connection method of column-foundation (outside of column) can be applied to the connection located on both sides of the foundation steel columns 12, as a connection method of column-foundation (outside of column) with double-pivot connection (as shown in FIG. 25).

Furthermore, the mounting and connecting method of the first pivot element 5A is to fasten and mount the beams and columns 21, which are connected to each other in pairs, having the degrees of freedom to be zero so that rotation and movement will not occur and the foundation becomes stronger and firm.

The assembly method of the second pivot element 5B.

Figure 26:
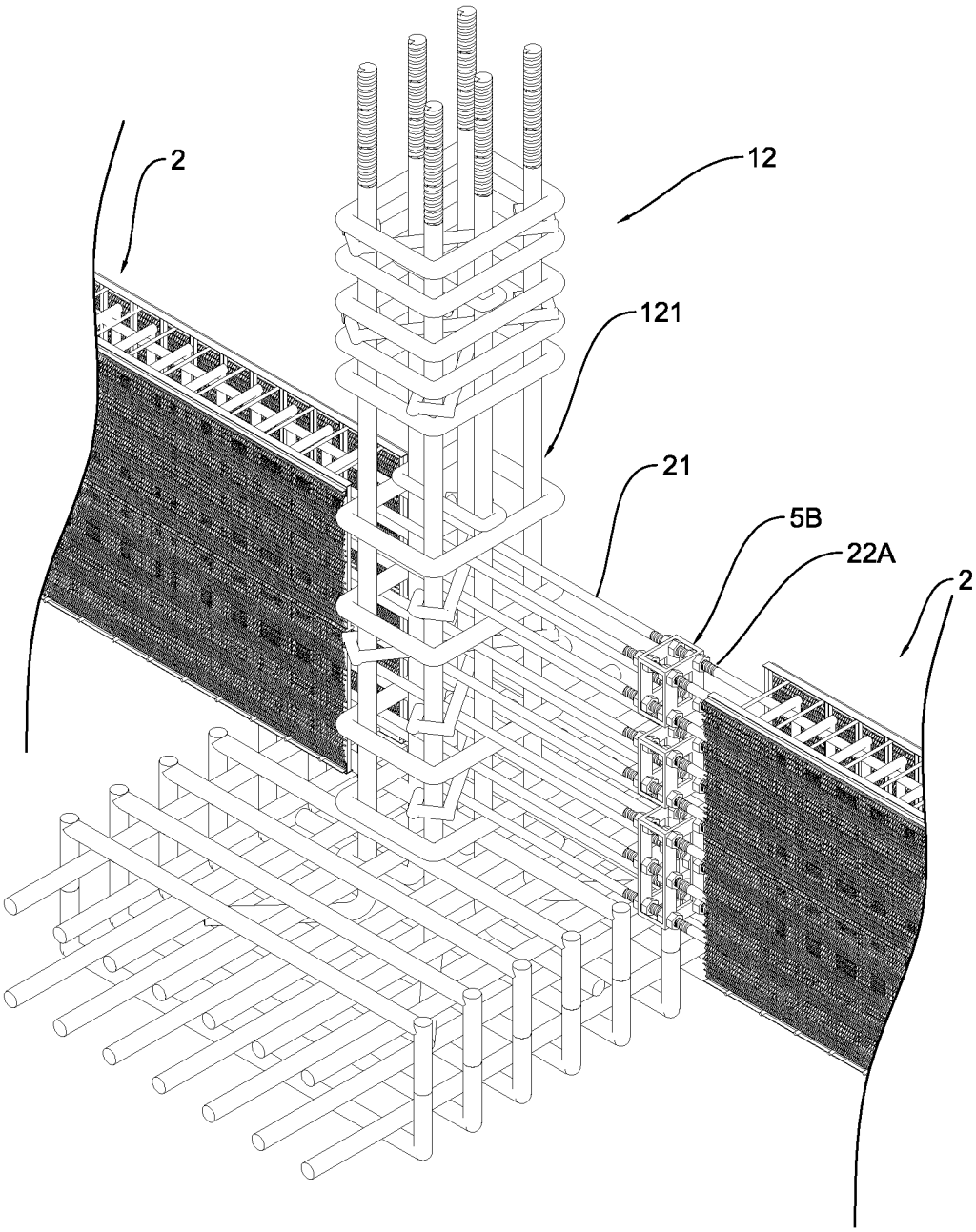
FIG. 26 is a schematic diagram of the assembly of the second pivot elements of the invention.

Referring to FIG. 26, install the mounting elements 6 and washers 7 on one of two horizontal pivot sections 22A of two foundation rebars 2 that are connected to each other. Align the horizontal pivot sections 22A with the positioning holes 521 and insert therein. Next, install the mounting elements 6 and washers 7 on the other of two horizontal pivot sections 22A. Last, all mounting elements 6 are fastened to complete the pivot joint of the second pivot elements 5B.

The mounting and connecting method of the second pivot element 5B is to fasten and mount the beams and columns 21, which are connected to each other in pairs, having the degrees of freedom to be zero so that rotation and movement will not occur and the foundation becomes stronger and firm.

The assembly method of the third pivot element 5C.

Referring to FIG. 27 to FIG. 30, the third pivot element 5C is used to connect two foundation rebars 2 and a foundation steel column 12. The third pivot element 5C is installed on the back of the horizontal pivot sections 22B of two foundation rebars 2 separately that are connected to the foundation steel column 12 individually. Using the welding method, solder in high temperature piles up on the third pivot element 5C and gradually fills up the gap between these two horizontal pivot sections 22B; these two horizontal pivot sections 22B eventually become connected to each other at last.

Figure 27:
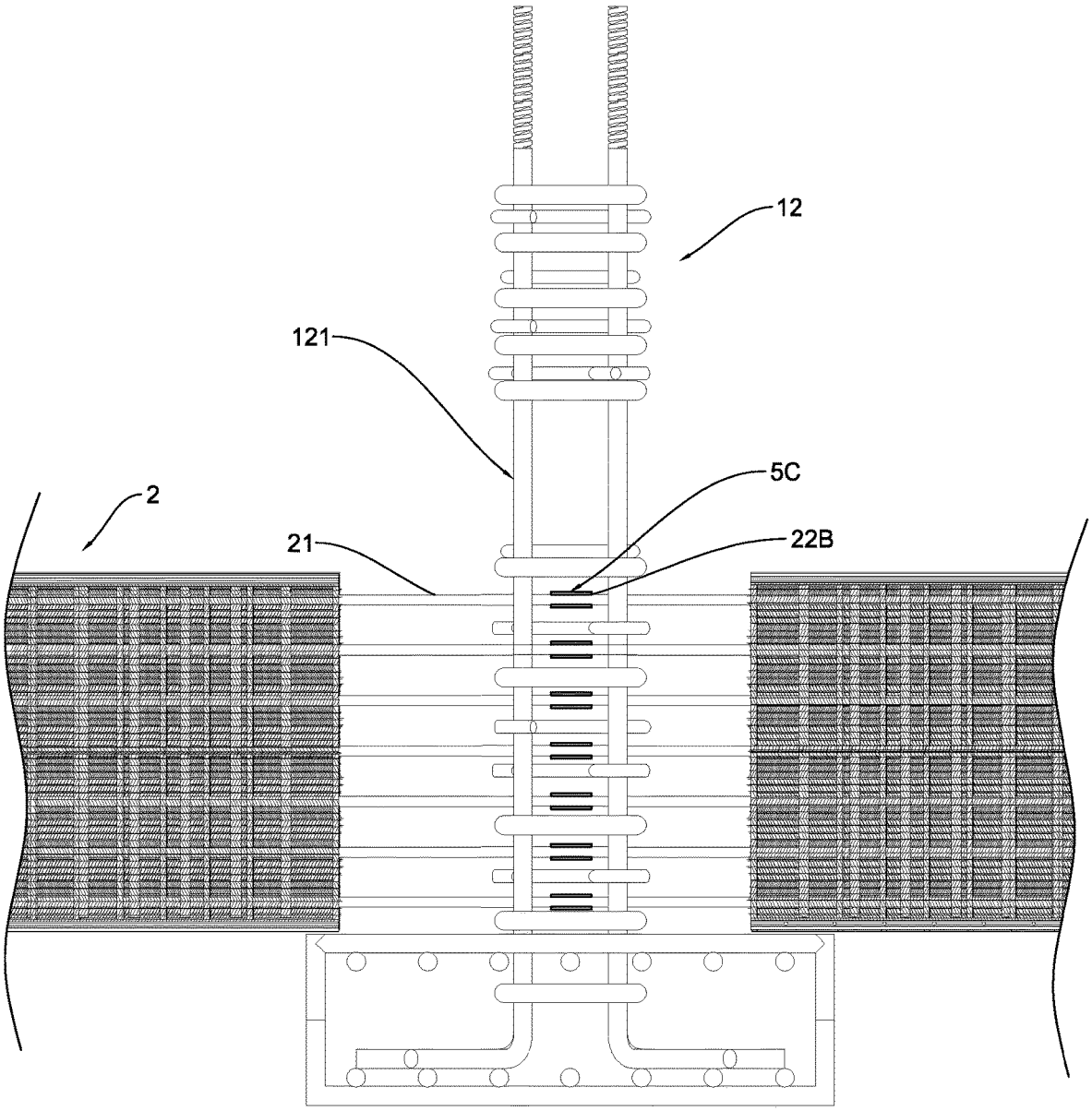
FIG. 27 is a schematic diagram of the assembly of the third pivot elements of the invention.
Figure 28:
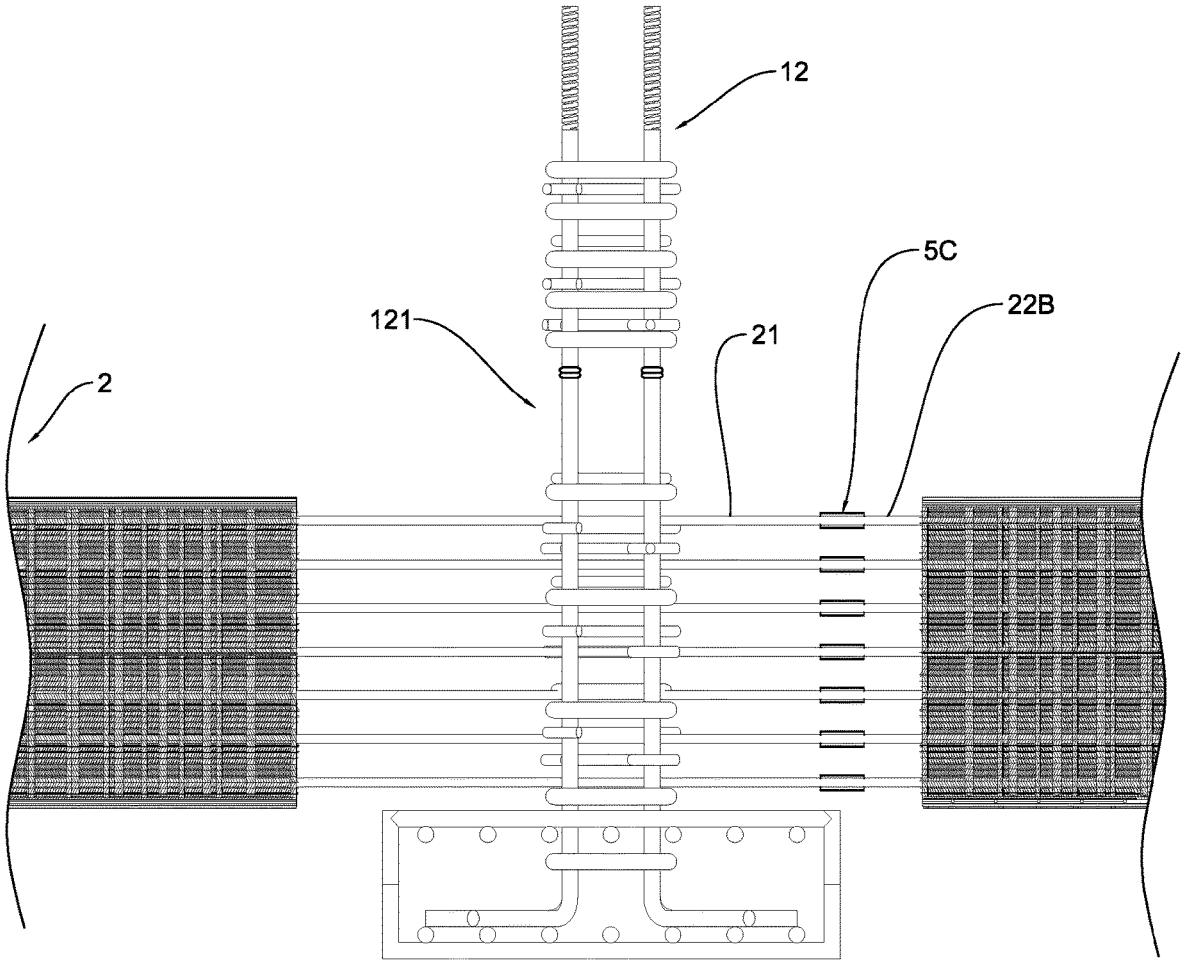
FIG. 28 is another schematic diagram of the assembly of the third pivot elements of the invention.
Figure 29:
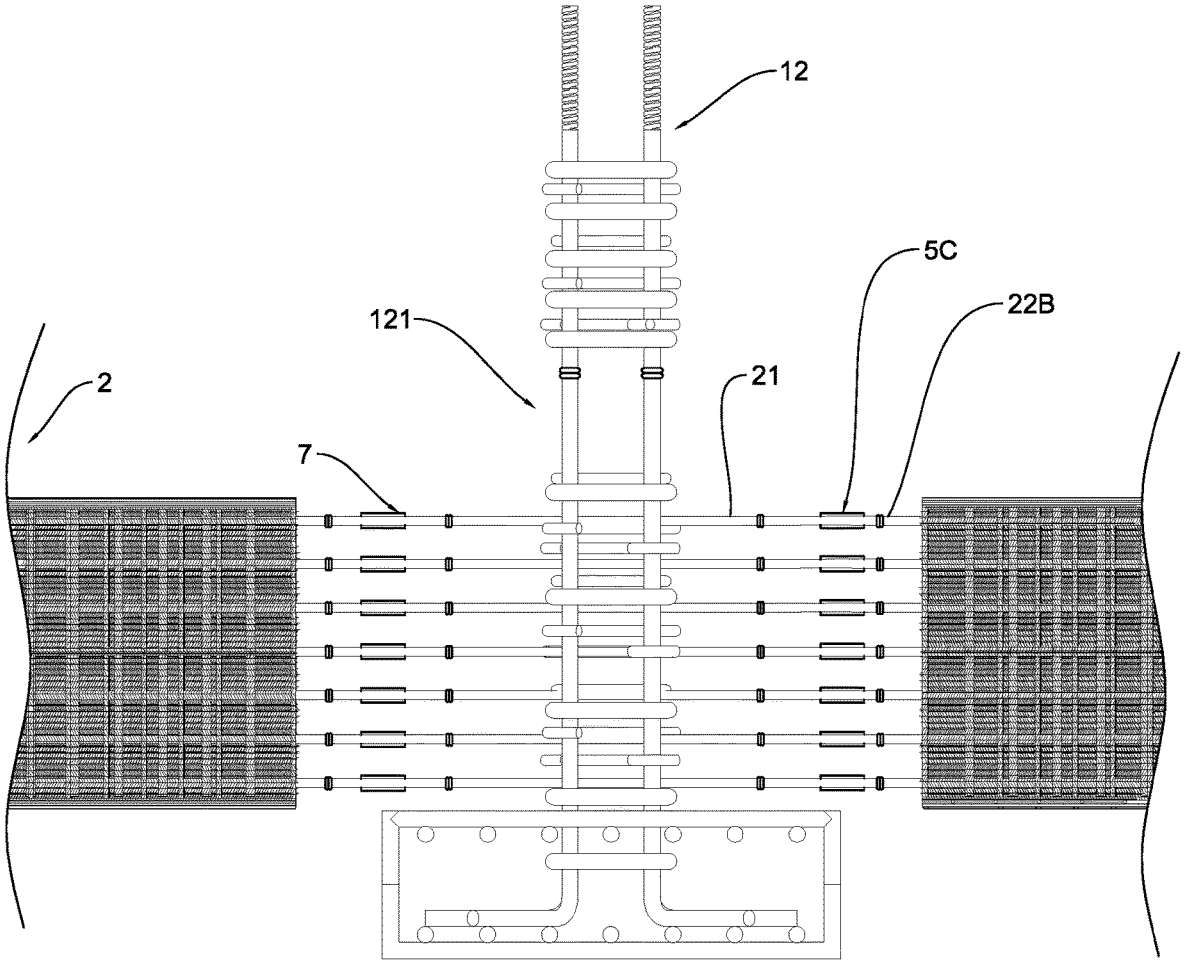
FIG. 29 is yet another schematic diagram of the assembly of the third pivot elements of the invention.
Figure 30:
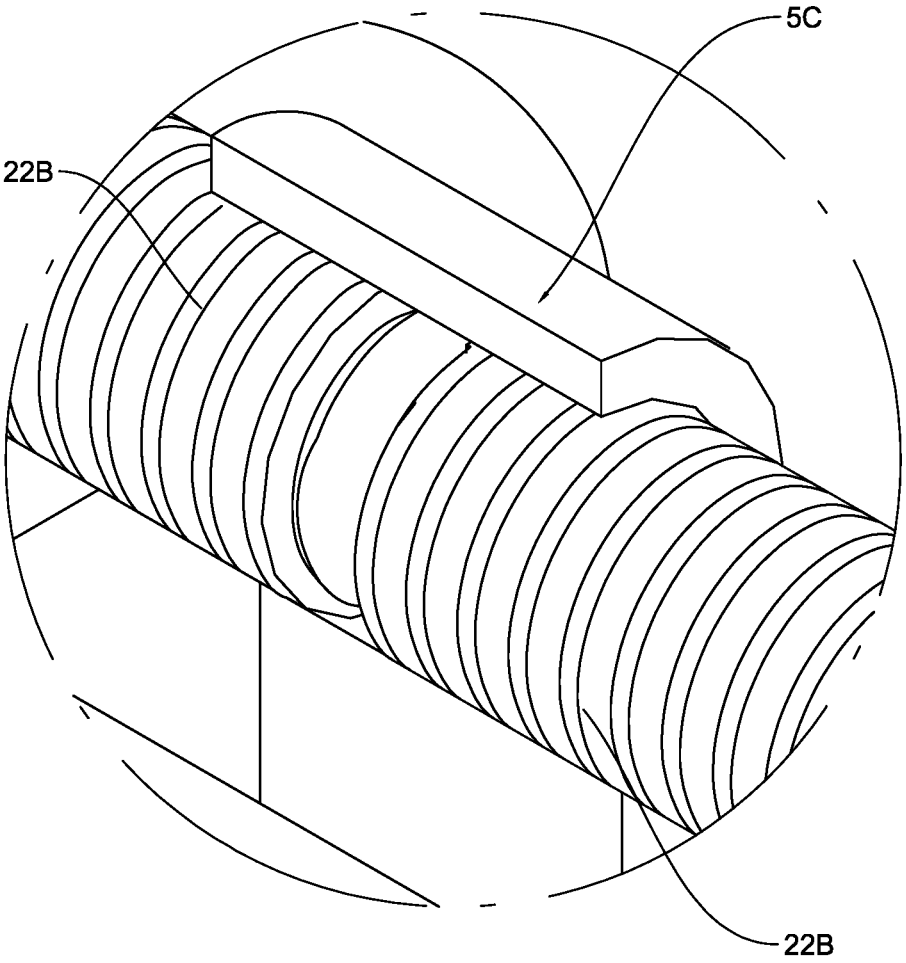
FIG. 30 is an enlarged partial view of the embodiment of the third pivot element of the invention.

The location of the connection joint of the third pivot element 5C can be inside the foundation steel columns 12 and a proper location on the side of the foundation steel columns 12. The beams and columns 21 of two foundation rebars 2 penetrate through the foundation steel columns 12, and are welded to the horizontal pivot sections 22B within the foundation steel columns 12 using the third pivot elements 5C. This process is a connection method of column-foundation (inside of column) (as shown in FIG. 27). The same welding operation can be applied to a proper location on the side of the foundation steel columns 12. A foundation rebar 2 is inserted horizontally through the foundation steel column 12 and the horizontal pivot section 22B is in contact with the horizontal pivot section 22B of another foundation rebar 2. A third pivot element 5C is used to connect these two horizontal pivot section 22B separately. This process is a connection method of column-foundation (outside of column) (as shown in FIG. 28). The connection method of column-foundation (outside of column) can be applied to the connection located on both sides of the foundation steel columns 12, as a connection method of column-foundation (outside of column) with double-pivot connection (as shown in FIG. 29). The welding The connection method of column-foundation (outside of column) can be applied to the connection located on both sides of the foundation steel columns 12, as a connection method of column-foundation (outside of column) with double-pivot connection (as shown in FIG. 25). of the aforementioned third pivot element 5C is demonstrated in FIG. 30.

In addition, the mounting and fastening method of the third pivot element 5C is to fasten and mount the beams and columns 21, which are connected to each other in pairs, having the degrees of freedom to be zero, so that rotation and movement will not occur and the foundation becomes stronger and firm.

The aforementioned three forms of pivot connection can be applied by construction workers at the construction site. Construction workers can connect one foundation rebar 2 with different forms of a pivot element 5. These three connection methods of the pivot element 5 can retain and mount the beams and columns, which are connected to each other in pairs, restrain beams and columns from rotating, and increase the stability and firmness of the foundation.

The invention has the following advantages and benefits in comparison with the conventional art: pre-assemble the bottom layer rebars of the foundation slab 11, foundation steel columns 12, the upper layer rebars of the foundation slab 13, and the foundation rebars 2 completely prior to being transported to the construction site for further assembly. Therefore, the construction workers no longer have to bundle rebars, and the effect of shortening the construction time and reducing the number of needed construction workers can be achieved.

While the invention has been described in terms of preferred embodiments, those skilled in the art will recognize that the invention can be practiced with modifications within the spirit and scope of the appended claims.

What is claimed is:

1. A pre-assembled raft foundation, comprising:

a plurality of bottom layer rebars of a foundation slab including a plurality of bottom layer sections and a plurality of first vertical sections connected to the bottom layer sections wherein the bottom layer sections and the first vertical sections are composed of a plurality of U-shaped rebars and a plurality of steel bars disposed on the U-shaped rebars;

a plurality of foundation steel columns disposed on the bottom layer sections and including a plurality of columns and a plurality of vertical sections disposed at tops of the columns;

a plurality of upper layer rebars of the foundation slab disposed on the bottom layer rebars of the foundation slab and including a plurality of top layer sections and a plurality of second vertical sections connected to the top layer sections wherein the top layer sections and the second vertical sections are composed of a plurality of U-shaped rebars and a plurality of steel bars disposed on the U-shaped rebars; and a plurality of foundation rebars disposed on a side of the foundation steel columns and including a plurality of beams and columns, a plurality of horizontal sections disposed at both ends of the beams and columns, and a plurality of steel mesh structures wherein the beams and columns are tied together by a plurality of circular rebars and fastened by a plurality of steel mesh structures disposed above and below the beams and columns;

wherein the bottom layer rebars of the foundation slab, the foundation steel columns, the upper layer rebars of the foundation slab, and the foundation rebars are assembled into a pre-assembled raft foundation.

2. The pre-assembled raft foundation of claim 1, wherein an outer part of a frame of the pre-assembled raft foundation is built with a formwork and the formwork is a removable formwork or a non-removable formwork.

3. The pre-assembled raft foundation of claim 1, wherein the vertical sections and the horizontal sections are disposed with a plurality of first elements thereon for connecting to the beams and columns; each of the first elements have a through hole and an internal thread through an internal surface of the through hole; both ends of each of the first elements are connected to the horizontal sections and the beams and columns respectively; and both ends of the internal thread of each of the first elements have an internal guide section respectively.

4. The pre-assembled raft foundation of claim 1, wherein the vertical sections and the horizontal sections are disposed with a plurality of second elements thereon for connecting to the beams and columns; each of the second elements are a frame body having a plurality of positioning holes with the horizontal sections and the beams and columns insert thereinto, and a containing space through the positioning holes; and each of the second elements hold up a mounting element to be disposed on the horizontal sections and the beams and columns so that the horizontal sections and the beams and columns are mounted on the frame body.

5. The pre-assembled raft foundation of claim 1, wherein the vertical sections and the horizontal sections are disposed with third a plurality of elements thereon for connecting to the beams and columns; each of the third elements are a backing plate made of carbon-based materials; the backing plate is configured to withstand a high temperature of over 1500° C.; and an outer appearance of the backing plate has an arc shape or a flat shape, or is a flat plate with a groove.

* * * * *